US010378716B2

(12) United States Patent
Sato

(10) Patent No.: US 10,378,716 B2
(45) Date of Patent: Aug. 13, 2019

(54) VEHICLE LAMP

(71) Applicant: KOITO MANUFACTURING CO., LTD., Tokyo (JP)

(72) Inventor: Noriko Sato, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 0 days.

(21) Appl. No.: 15/740,970

(22) PCT Filed: Jun. 24, 2016

(86) PCT No.: PCT/JP2016/068901
§ 371 (c)(1),
(2) Date: Dec. 29, 2017

(87) PCT Pub. No.: WO2017/002736
PCT Pub. Date: Jan. 5, 2017

(65) Prior Publication Data

US 2018/0187854 A1 Jul. 5, 2018

(30) Foreign Application Priority Data

Jun. 29, 2015 (JP) ..... 2015-129567
Jun. 29, 2015 (JP) ..... 2015-129826

(51) Int. Cl.
*F21S 41/00* (2018.01)
*F21S 41/32* (2018.01)
(Continued)

(52) U.S. Cl.
CPC ..... *F21S 41/36* (2018.01); *F21S 41/00* (2018.01); *F21S 41/147* (2018.01);
(Continued)

(58) Field of Classification Search
CPC ..... F21S 41/36; F21S 41/663; F21S 41/147; F21S 41/00; F21S 41/148; F21S 41/151
(Continued)

(56) References Cited

U.S. PATENT DOCUMENTS 5,422,623 A * 6/1995 Bader ..... B60Q 1/2611 340/331
2005/0231971 A1* 10/2005 Ishida ..... B60Q 1/04 362/512
(Continued)

FOREIGN PATENT DOCUMENTS

JP 2005-294166 A 10/2005
JP 2009-218155 A 9/2009
(Continued)

OTHER PUBLICATIONS

International Search Report issued in corresponding application No. PCT/JP2016/068901 dated Sep. 13, 2016 (4 pages).
(Continued)

*Primary Examiner* — Bryon T Gyllstrom
(74) *Attorney, Agent, or Firm* — Osha Liang LLP

(57) ABSTRACT

A first lamp unit includes a plurality of first light-emitting elements arranged in a vehicle width direction. A second lamp unit includes a plurality of second light-emitting elements arranged in the vehicle width direction. A wiring channel of a first type lights at least one of the first light-emitting elements by supplying power thereto, thereby forming a light distribution pattern of a first type. A wiring channel of a second type connects at least one of the first light-emitting elements in series with at least one of the second light-emitting elements, and lights these by supplying power thereto, thereby forming a light distribution pattern of a second type. The position of a light-dark boundary that extends vertically in the light distribution pattern of the first type is different from the position of a
(Continued)

light-dark boundary that extends vertically in the light distribution pattern of the second type.

18 Claims, 22 Drawing Sheets

(51) Int. Cl.

| | |
|---|---|
| ***F21S 41/36*** | (2018.01) |
| ***F21S 41/143*** | (2018.01) |
| ***F21S 41/147*** | (2018.01) |
| ***F21S 41/148*** | (2018.01) |
| ***F21S 41/151*** | (2018.01) |
| ***F21S 41/255*** | (2018.01) |
| ***F21S 41/663*** | (2018.01) |
| ***F21Y 103/10*** | (2016.01) |
| ***F21Y 103/30*** | (2016.01) |

(52) U.S. Cl.
CPC ..... *F21S 41/148* (2018.01); *F21S 41/151* (2018.01); *F21S 41/663* (2018.01); *F21S 41/143* (2018.01); *F21S 41/255* (2018.01); *F21S 41/321* (2018.01); *F21Y 2103/10* (2016.08); *F21Y 2103/30* (2016.08)

(58) Field of Classification Search
USPC ..... 362/516
See application file for complete search history.

(56) References Cited

U.S. PATENT DOCUMENTS

2006/0285347 A1* 12/2006 Okada ..... F21S 41/143 362/516
2007/0086202 A1* 4/2007 Tsukamoto ..... F21S 41/147 362/514
2007/0171650 A1* 7/2007 Ishida ..... F21S 41/147 362/307
2007/0291501 A1* 12/2007 Yagi ..... F21S 41/147 362/509
2009/0231866 A1* 9/2009 Yamamura ..... B60Q 1/085 362/466
2011/0080753 A1* 4/2011 Hering ..... B60Q 1/20 362/545
2012/0176809 A1* 7/2012 Ohno ..... F21S 41/322 362/510
2013/0003403 A1* 1/2013 Takahira ..... B60Q 1/0023 362/538
2013/0286674 A1* 10/2013 Oguchi ..... F21V 7/00 362/516
2013/0314936 A1* 11/2013 Yamamura ..... F21S 41/19 362/516

FOREIGN PATENT DOCUMENTS

JP 2013-211211 A 10/2013
JP 2013-243080 A 12/2013
JP 2014-038701 A 2/2014
JP 2014-120221 A 6/2014

OTHER PUBLICATIONS

Written Opinion of the International Searching Authority issued in corresponding application No. PCT/JP2016/068901 dated Sep. 13, 2016 (5 pages).

* cited by examiner

VEHICLE LAMP

CROSS-REFERENCE TO RELATED APPLICATIONS

The present application claims foreign priority to Japanese Patent Application No. 2015-129567 filed on Jun. 29, 2015, and Japanese Patent Application No. 2015-129826 filed on Jun. 29, 2015, the contents of which are incorporated herein by reference in their entirety.

BACKGROUND

Technical Field

The disclosure relates to a vehicle lamp including a lamp unit configured to use a light-emitting element as a light source.

Related Art

Japan Patent Publication No. 2013-243080 discloses a vehicle lamp having a plurality of light-emitting elements arranged in a vehicle width direction.

The light emitted from the plurality of light-emitting elements is reflected ahead of the vehicle lamp by a reflector.

In the vehicle lamp disclosed in Japan Patent Publication No. 2013-243080, at least a part of the plurality of light-emitting elements is lighted to form a plurality of types of light distribution patterns in which positions of light-dark boundaries extending in an upper and lower direction are different.

SUMMARY OF THE INVENTION

However, the vehicle lamp disclosed in Japan Patent Publication No. 2013-243080 is configured so that the plurality of light-emitting elements arranged in the lamp unit is to be independently turned on and off. For this reason, the same number of wiring channels as the plurality of light-emitting elements is required. Also, when a plurality of the lamp units is provided, the number of wiring channels remarkably increases.

Therefore, a configuration of a lighting control circuit for forming the plurality of types of light distribution patterns is complicated and it is necessary to detect a breaking or a short for each of the numerous wiring channels, so that the cost inevitably increases.

A vehicle lamp according to one or more embodiments of the present invention comprises a plurality of lamp units configured to use a light-emitting element as a light source and capable of forming a plurality of types of light distribution patterns, in which positions of light-dark boundaries extending in an upper and lower direction are different, by an inexpensive configuration.

When a plurality of light-emitting elements is arranged side by side in a vehicle width direction, light emitted from a light-emitting element, which is arranged at a more distant position from a focus of a reflective surface of a reflector in the vehicle width direction, is more diffused in the upper and lower direction by the reflector than light emitted from a light-emitting element, which is arranged at a closer position to the focus in the vehicle width direction.

In the vehicle lamp disclosed in Japan Patent Publication No. 2013-243080, the plurality of light-emitting elements is arranged on the same line extending in the vehicle width direction. For this reason, a light distribution pattern that is to be formed by simultaneous lighting of the plurality of light-emitting elements has such a shape that both end portions in a right and left direction are convex upward and downward. In particular, when the downward convex sagging portion illuminates a road surface ahead of a vehicle, the road surface gets light beyond necessity, so that the visibility may be instead lowered.

A vehicle lamp according to one or more embodiments of the present invention is configured to reflect forward light, which is to be emitted from a plurality of light-emitting elements arranged in a vehicle width direction, by a reflector and capable of suppressing the visibility of a road surface ahead of a vehicle from being lowered.

A vehicle lamp according to one or more embodiments of the present invention includes: a first lamp unit having a plurality of first light-emitting elements arranged in a vehicle width direction, a second lamp unit having a plurality of second light-emitting elements arranged in the vehicle width direction, a first-type wiring channel configured to turn on at least one of the plurality of first light-emitting elements by supply of power and to form a first-type light distribution pattern, and a second-type wiring channel configured to connect at least one of the plurality of first light-emitting elements in series with at least one of the plurality of second light-emitting elements, to turn on the light-emitting elements by supply of power and to form a second-type light distribution pattern, wherein a position of a light-dark boundary extending in an upper and lower direction in the first-type light distribution pattern is different from a position of a light-dark boundary extending in the upper and lower direction in the second-type light distribution pattern.

A type of the "light-emitting element" is not particularly limited. For example, a light-emitting diode, a laser diode, an organic EL element and the like can be adopted.

A specific configuration of the "lamp unit" is not particularly limited inasmuch as it can form a light distribution pattern having a light-dark boundary extending in the upper and lower direction. For example, a configuration of reflecting light from the light-emitting element by a reflector, a configuration of deflecting forward light from the light-emitting element by a lens, and the like can be adopted.

The "light-dark boundary" is not required to necessarily extend in a vertical direction inasmuch as it extends in the upper and lower direction. For example, the light-dark boundary may extend in a linear or curved shape in a direction inclined relative to the vertical direction.

According to the above configuration, since the wiring channel configured to connect in series the light-emitting elements included in the different lamp units is provided, it is possible to suppress an increase in the number of wiring channels even though the plurality of lamp units is provided. Thereby, it is possible to simplify a configuration of a lighting control circuit and to easily detect a breaking or a short of each wiring channel, so that it is possible to suppress the cost increase.

Also, even though the plurality of lamp units configured to use the light-emitting elements as a light source is provided, it is possible to form a plurality of types of light distribution patterns, in which the positions of the light-dark boundaries extending in the upper and lower direction are different, by the inexpensive configuration.

The vehicle lamp may be configured so that a shape of the first-type light distribution pattern is different from a shape of the second-type light distribution pattern. According to this configuration, it is possible to improve degrees of freedom of a shape and a light intensity distribution of a light distribution pattern that is to be formed by a combination of the light distribution patterns.

The vehicle lamp may be configured so that brightness of the first-type light distribution pattern is different from brightness of the second-type light distribution pattern. According to this configuration, it is possible to improve degrees of freedom of the maximum light intensity and the light intensity distribution of a light distribution pattern that is to be formed by a combination of the light distribution patterns.

The vehicle lamp may be configured so that a distance in the vehicle width direction between an optical axis of the first lamp unit and an arrangement center of the plurality of first light-emitting elements is different from a distance in the vehicle width direction between an optical axis of the second lamp unit and an arrangement center of the plurality of second light-emitting elements. According to this configuration, it is possible to easily form a plurality of types of light distribution patterns in which the positions of the light-dark boundaries extending in the upper and lower direction are different.

The vehicle lamp may be configured so that an arrangement interval of the plurality of first light-emitting elements is different from an arrangement interval of the plurality of second light-emitting elements. According to this configuration, it is possible to easily form a plurality of types of light distribution patterns in which the positions of the light-dark boundaries extending in the upper and lower direction are different.

The vehicle lamp may be configured so that a number of the plurality of first light-emitting elements is different from a number of the plurality of second light-emitting elements. According to this configuration, it is possible to easily form a plurality of types of light distribution patterns having different sizes.

A vehicle lamp according to one or more embodiments of the present invention includes: a plurality of light-emitting elements arranged in a vehicle width direction, and a reflector having a parabolic reflective surface configured to reflect forward light emitted from the plurality of light-emitting elements, wherein the reflective surface is arranged above or below the plurality of light-emitting elements, wherein when the reflective surface is arranged below the plurality of light-emitting elements, the plurality of light-emitting elements is arranged so that a light-emitting element located at a more distant position from a focus of the reflective surface in the vehicle width direction is located at a more forward position, and wherein when the reflective surface is arranged above the plurality of light-emitting elements, the plurality of light-emitting elements is arranged so that a light-emitting element located at a more distant position from the focus of the reflective surface in the vehicle width direction is located at a more backward position.

A type of the "light-emitting element" is not particularly limited. For example, a light-emitting diode, a laser diode, an organic EL element and the like can be adopted.

A specific configuration of the "reflector" is not particularly limited inasmuch as it has a parabolic reflective surface.

The "parabolic reflective surface" means a reflective surface configured by a rotational paraboloid itself, a reflective surface including a plurality of reflection elements formed thereon and having a rotational paraboloid as a reference surface, or a reflective surface formed by deforming a part of a rotational paraboloid.

Like the vehicle lamp of the related art, the light emitted from a light-emitting element, which is arranged at a more distant position from the focus of the reflective surface of the reflector in the vehicle width direction, is more diffused in the upper and lower direction by the reflector than the light emitted from a light-emitting element, which is arranged at a closer position to the focus in the vehicle width direction.

However, when the reflective surface of the reflector is arranged below the plurality of light-emitting elements, the plurality of light-emitting elements is arranged so that a light-emitting element located at a more distant position from the focus of the reflective surface in the vehicle width direction is located at a more forward position. Thereby, as compared to the configuration of the related art where all the light-emitting elements are arranged on the same line extending in the vehicle width direction, it is possible to reduce a degree of downward diffusion by the reflector.

Alternatively, when the reflective surface is arranged above the plurality of light-emitting elements, the plurality of light-emitting elements is arranged so that a light-emitting element located at a more distant position from the focus of the reflective surface in the vehicle width direction is located at a more backward position. Thereby, as compared to the configuration of the related art where all the light-emitting elements are arranged on the same line extending in the vehicle width direction, it is possible to reduce a degree of downward diffusion by the reflector.

Therefore, in the light distribution pattern that is to be formed by simultaneous lighting of the plurality of light-emitting elements, it is possible to make it difficult for a sagging portion to be formed at both end portions in a right and left direction, so that it is possible to avoid excessive illumination to a road surface ahead of the vehicle.

The light emitted from the light-emitting element, which is arranged at a relatively distant position from the focus in the vehicle width direction, is more diffused upward by the reflector, as compared to the configuration of the related art where all the light-emitting elements are arranged on the same line extending in the vehicle width direction. However, since the reflected light thereof is not illuminated to the road surface ahead of the vehicle, it is not necessary to consider the excessive illumination.

Therefore, when the vehicle lamp configured to reflect forward the light, which is to be emitted from the plurality of light-emitting elements arranged in the vehicle width direction, by the reflector is provided, it is possible to avoid the excessive illumination to the road surface ahead of the vehicle, so that it is possible to suppress the visibility of the road surface from being lowered.

The vehicle lamp may be configured so that a distance in the vehicle width direction between a light-emitting center of a light-emitting element, which is located at the most distant position from the focus in the vehicle width direction, of the plurality of light-emitting elements and the focus is one-fifth or longer of a focal distance of the reflective surface. According to this configuration, the above-described effects are more conspicuous.

When the distance in the vehicle width direction is large, the light distribution pattern, which is to be formed by the simultaneous lighting of the plurality of light-emitting elements, has large sagging portions at both end portions thereof in the right and left direction if the plurality of light-emitting elements is arranged on the same line extending in in the vehicle width direction, like the related art. However, the above configuration is adopted, so that it is possible to effectively suppress the large sagging portion from being formed.

The vehicle lamp may be configured so that a distance in a front and back direction of a vehicle between a light-emitting center of a light-emitting element, which is located at the most distant position from the focus in the vehicle width direction, of the plurality of light-emitting elements and the focus is one-tenth or longer of the distance in the vehicle width direction between the light-emitting center and the focus. According to this configuration, it is possible to more effectively suppress the large sagging portion from being formed at both end portions in the right and left direction of the light distribution pattern, which is to be formed by the simultaneous lighting of the plurality of light-emitting elements.

The vehicle lamp may be configured so that at least one of the plurality of light-emitting elements can be selectively turned on and off. According to this configuration, it is possible to form a plurality of types of shapes of light distribution patterns, in addition to the light distribution pattern, which is to be formed by the simultaneous lighting of all the plurality of light-emitting elements. In this case, when the light-emitting elements to be selectively turned on and off are appropriately combined, it is possible to widely illuminate a forward traveling road without causing a glare to a driver of an oncoming vehicle or a forward traveling vehicle.

BRIEF DESCRIPTION OF THE DRAWINGS

FIG. 2 is rotated by 180°.

FIG. 15 is rotated by 180°.

FIG. 19 depicts additive light distribution patterns, which are to be formed when a part of a plurality of light-emitting elements of the vehicle lamp in accordance with the second illustrative embodiment is turned on.

DETAILED DESCRIPTION

Hereinafter, examples of illustrative embodiments will be described in detail with reference to the accompanying drawings. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

Figure 1:
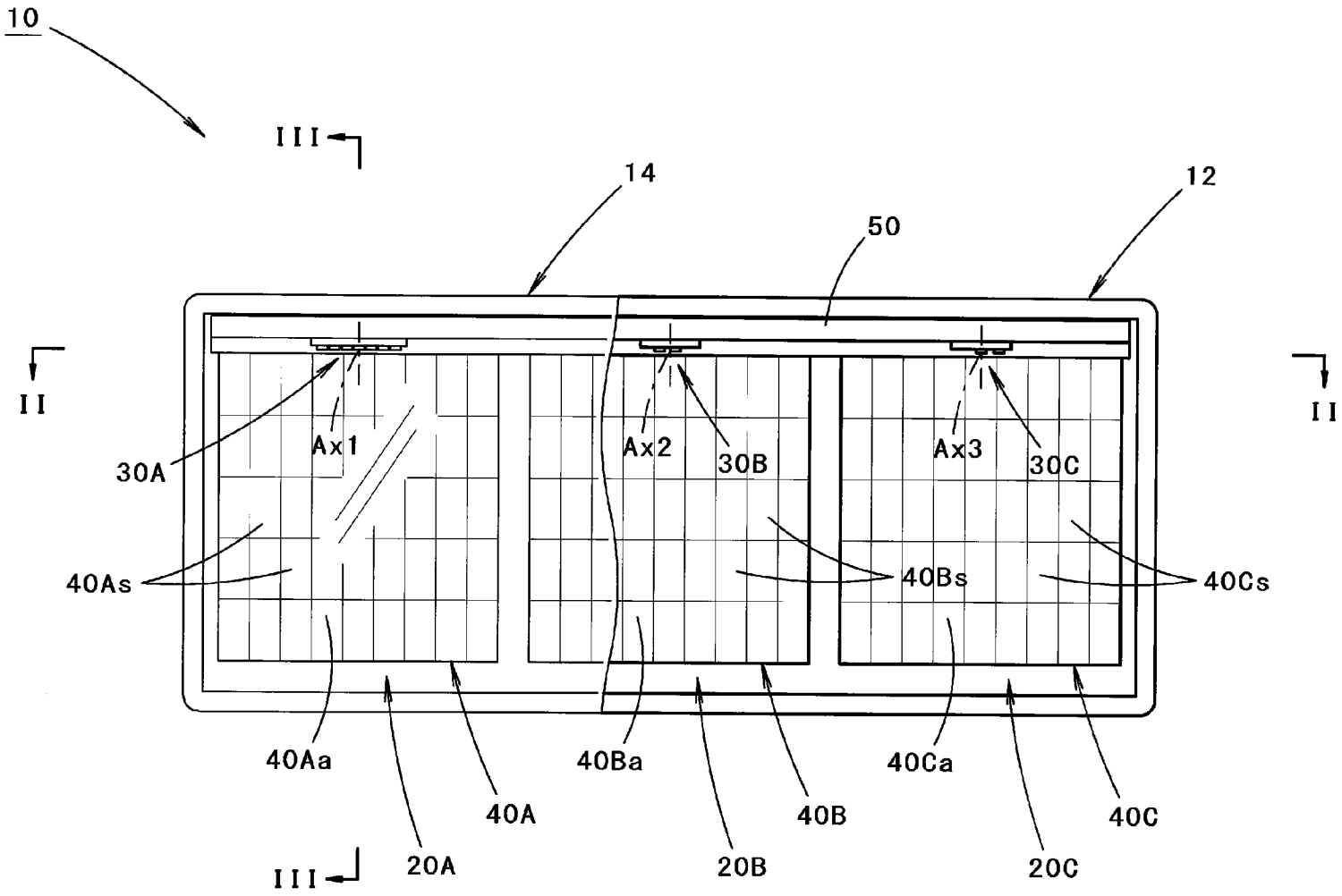
FIG. 1 is a front view depicting a vehicle lamp in accordance with a first illustrative embodiment.
Figure 2:
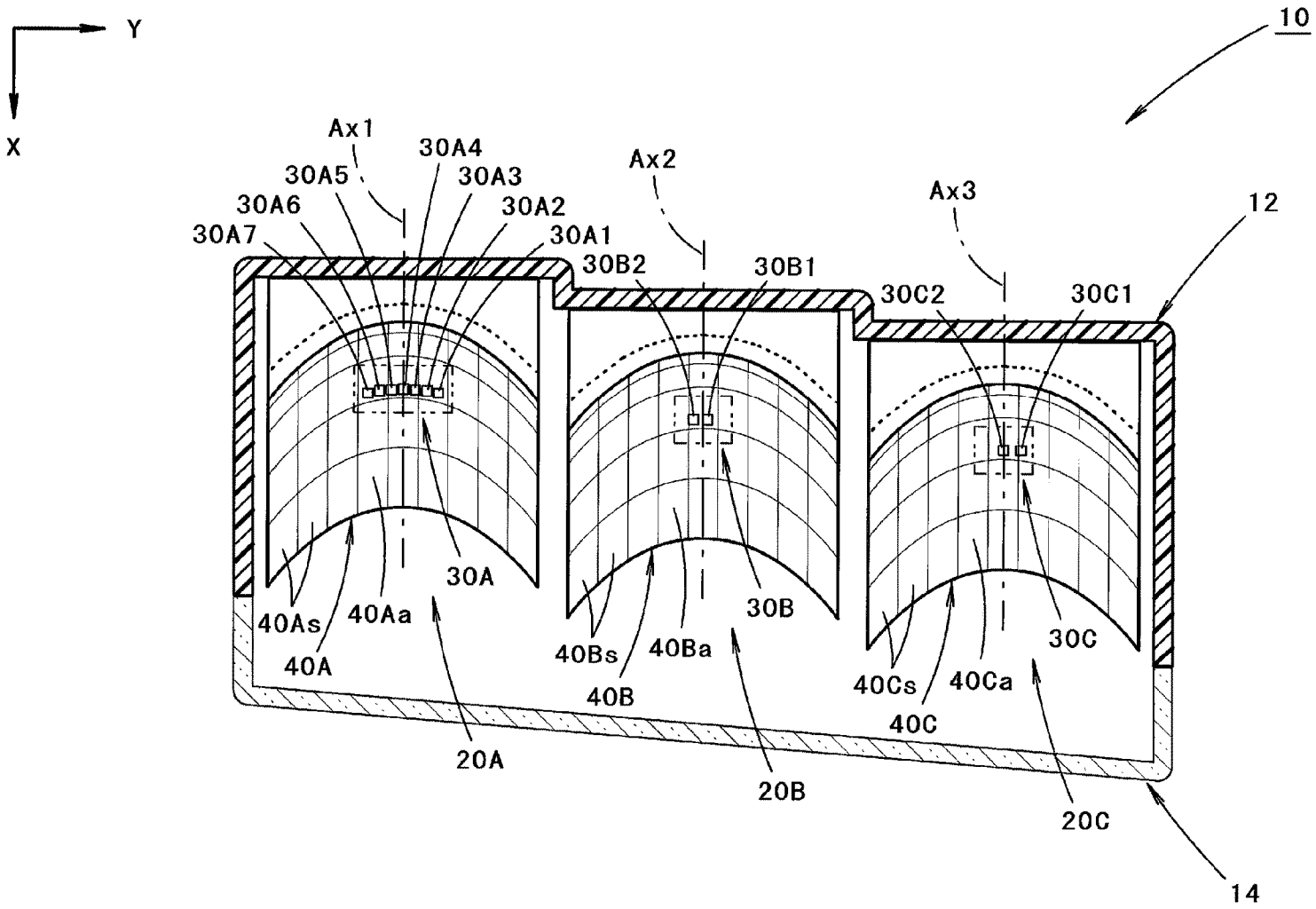
FIG. 2 is a sectional view taken along a line II-II of FIG. 1, as seen from an arrow direction.
Figure 3:
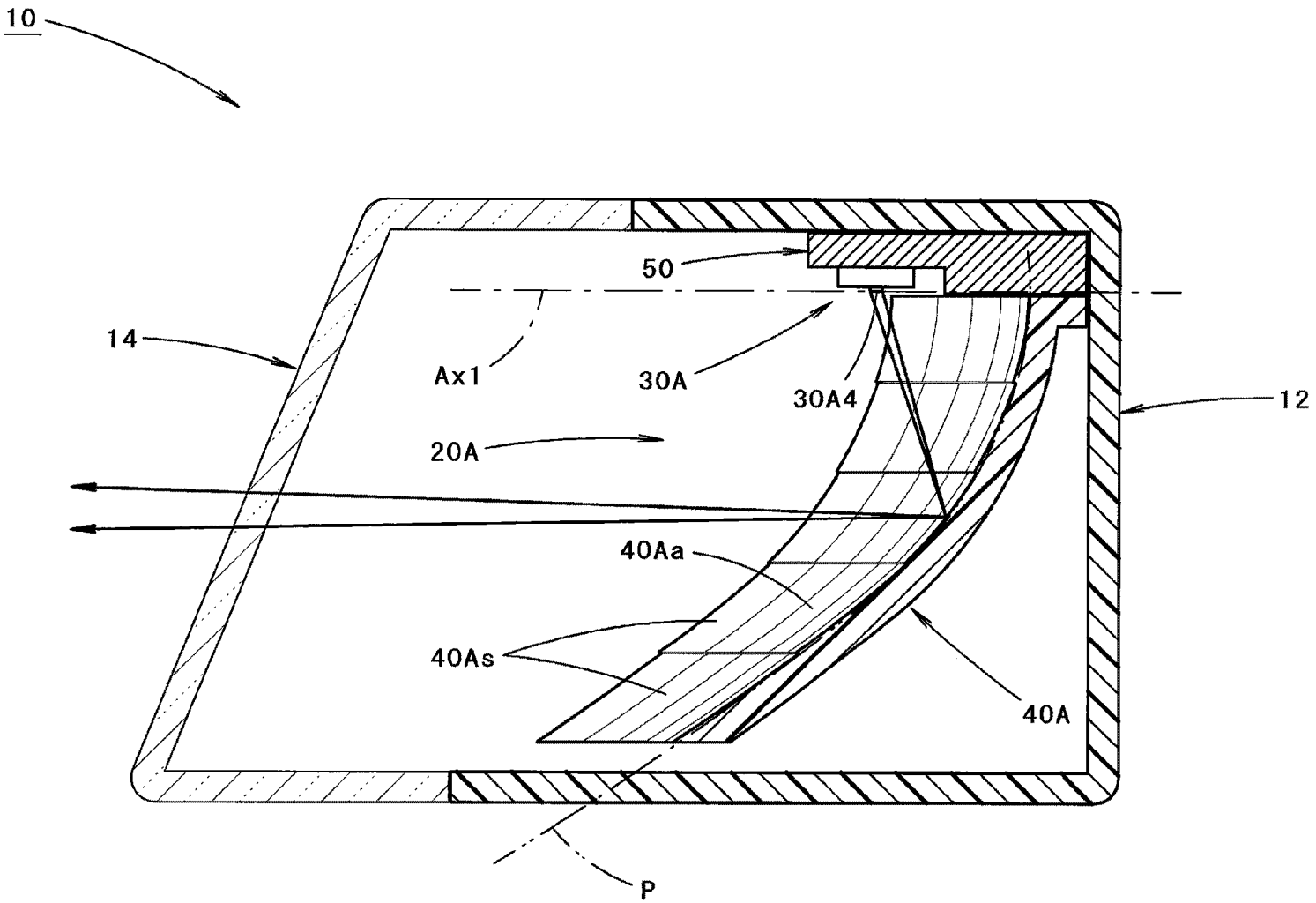
FIG. 3 is a sectional view taken along a line III-III of FIG. 1, as seen from an arrow direction.

FIG. 1 is a front view depicting a vehicle lamp 10 in accordance with a first illustrative embodiment. FIG. 2 is a sectional view taken along a line II-II of FIG. 1, as seen from an arrow direction. FIG. 3 is a sectional view taken along a line III-III of FIG. 1, as seen from an arrow direction.

The vehicle lamp 10 is a head lamp that is to be arranged at a right front end portion of a vehicle, and is configured to form an additive light distribution pattern (which will be described later) that is to be additionally formed to a light distribution pattern for low beam.

In the accompanying drawings, a direction denoted with X indicates "front", and a direction denoted with Y indicates a "left direction" perpendicular to "front". In the below descriptions, "left" and "right" indicate directions, as seen from a driver seat.

The vehicle lamp 10 has a configuration where three lamp units 20A, 20B, 20C are incorporated in a lamp chamber formed by a lamp body 12 and a translucent cover 14 mounted to a front end opening of the lamp body.

The three lamp units 20A, 20B, 20C are arranged in a vehicle width direction, and are also arranged so that a lamp unit positioned outward in the vehicle width direction is located at a more backward position.

The lamp unit 20A is configured as a reflector unit having a light source unit 30A and a reflector 40A. The lamp unit 20B is configured as a reflector unit having a light source unit 30B and a reflector 40B. The lamp unit 20C is configured as a reflector unit having a light source unit 30C and a reflector 40C. The lamp units 20A, 20B, 20C are supported to a common support member 50.

The light source unit 30A has seven light-emitting elements 30A1, 30A2, 30A3, 30A4, 30A5, 30A6, 30A7. The light source unit 30B has two light-emitting elements 30B1, 30B2. The light source unit 30C has two light-emitting elements 30C1, 30C2.

Each of the light-emitting elements 30A1 to 30A7, 30B1, 30B2, 30C1, 30C2 is a white light-emitting diode of the same specification having a rectangular (for example, a square shape of 1 mm) light-emitting surface, and is arranged with a light-emitting surface thereof facing downward. The light-emitting elements 30A1 to 30A7, 30B1, 30B2, 30C1, 30C2 are arranged so that both right and left end edges of each light-emitting surface thereof extend in a front and back direction of a vehicle.

Each of the reflectors 40A, 40B, 40C has a parabolic reflective surface.

A reflective surface 40Aa of the reflector 40A has a plurality of reflection elements 40As formed by using, as a reference surface, a rotational paraboloid P (refer to FIG. 3) of which a central axis is an optical axis Ax1 extending in the front and back direction of the vehicle, and is configured to reflect forward emission light from the light-emitting elements 30A1 to 30A7. A surface shape of each reflection element 40As is set so that the reflective surface 40Aa slightly deflects rightward the emission light from the light-emitting elements 30A1 to 30A7 and then slightly diffuses the same in both right and left directions.

A reflective surface 40Ba of the reflector 40B has a plurality of reflection elements 40Bs formed by using, as a reference surface, a rotational paraboloid of which a central axis is an optical axis Ax2 extending in the front and back direction of the vehicle, and is configured to reflect forward emission light from the light-emitting elements 30B1, 30B2. A surface shape of each reflection element 40Bs is set so that the reflective surface 40Ba slightly deflects rightward the emission light from the light-emitting elements 30B1, 30B2 and then slightly diffuses the same in both right and left directions.

A reflective surface 40Ca of the reflector 40C has a plurality of reflection elements 40Cs formed by using, as a reference surface, a rotational paraboloid of which a central axis is an optical axis Ax3 extending in the front and back direction of the vehicle, and is configured to reflect forward emission light from the light-emitting elements 30C1, 30C2. A surface shape of each reflection element 40Cs is set so that the reflective surface 40Ca slightly diffuses the emission light from the light-emitting elements 30C1 and 30C2 in both right and left directions.

The reflective surfaces 40Aa, 40Ba, 40Ca of the reflectors 40A, 40B, 40C have a substantially rectangular outer shape, respectively, as seen from the front of the lamp, and upper end edges thereof are positioned at substantially the same heights as the optical axes Ax1, Ax2, Ax3, respectively.

Figure 4:
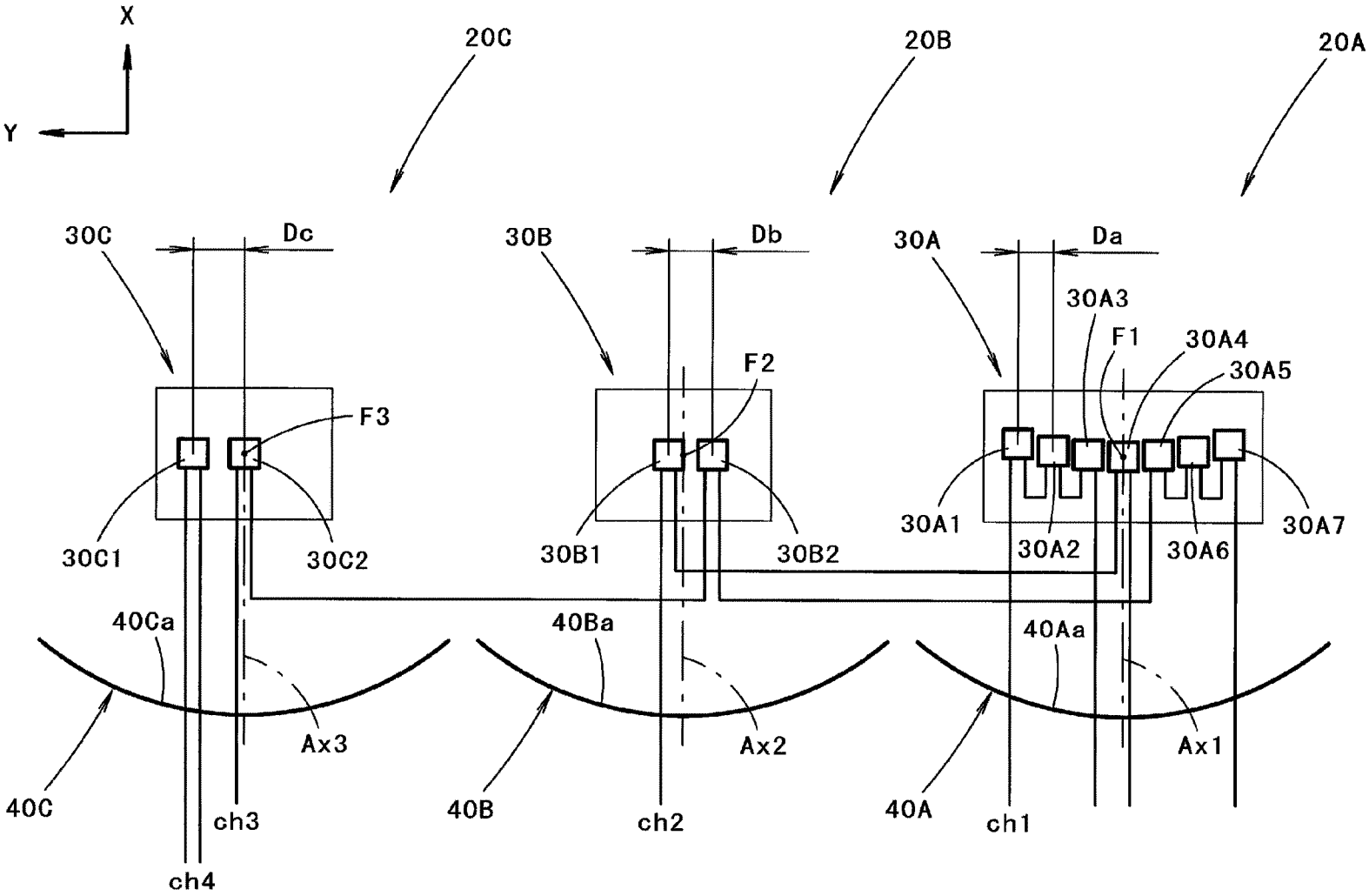
FIG. 4 is a plan view depicting a part of three lamp units configuring the vehicle lamp in accordance with the first illustrative embodiment at a state where

FIG. 4 is a plan view depicting a part of the three lamp units 20A, 20B, 20C at a state where FIG. 2 is rotated by 180°.

The seven light-emitting elements 30A1 to 30A7 configuring the light source unit 30A are arranged so that a light-emitting center of the central light-emitting element 30A4 is located at a focus F1 of the reflective surface 40Aa (correctly, a focus of the rotational paraboloid P), and the six light-emitting elements 30A1 to 30A3, 30A5 to 30A7 are arranged three by three with slight intervals at both right and left sides of the light-emitting element 30A4. The six light-emitting elements 30A1 to 30A3, 30A5 to 30A7 are arranged so that a light-emitting element located at a more distant position from the light-emitting element 30A4 is located at a position deviating more forward from the light-emitting element 30A4.

The two light-emitting elements 30B1, 30B2 configuring the light source unit 30B are arranged so that a center of a right edge of the light-emitting element 30B1 is positioned at a focus F2 of the reflective surface 40Ba, and the light-emitting element 30B2 is located at a position slightly distant rightward from the light-emitting element 30B1.

The two light-emitting elements 30C1, 30C2 configuring the light source unit 30C are arranged so that a light-emitting center of the light-emitting element 30C2 is positioned at a focus F3 of the reflective surface 40Ca, and the light-emitting element 30C1 is located at a position slightly distant leftward from the light-emitting element 30C2.

An intercentral distance Dc of the two light-emitting elements 30C1, 30C2 configuring the light source unit 30C is greater than an intercentral distance Db of the two light-emitting elements 30B1, 30B2 configuring the light source unit 30B. The intercentral distance Db of the two light-emitting elements 30B1, 30B2 configuring the light source unit 30B is greater than a mutual intercentral distance Da of the seven light-emitting elements 30A1 to 30A7 configuring the light source unit 30A.

The three light source units 30A, 30B, 30C are connected to a lighting control circuit (not shown). Wirings of the plurality of light-emitting elements 30A1 to 30A7, 30B1, 30B2, 30C1, 30C2 configuring the three light source units 30A, 30B, 30C are grouped into four wiring channels ch1 to ch4. The four wiring channels ch1 to ch4 are appropriately combined to control the lighting and lights-out.

The wiring channel ch1 (an example of the first-type wiring channel) is configured as a wiring channel to which the left three light-emitting elements 30A1 to 30A3 of the light source unit 30A are connected in series. The wiring channel ch2 (an example of the second-type wiring channel) is configured as a wiring channel to which the central light-emitting element 30A4 of the light source unit 30A and the left light-emitting element 30B1 of the light source unit 30B are connected in series. The wiring channel ch3 (an example of the second-type wiring channel) is configured as a wiring channel to which the right three light-emitting elements 30A5 to 30A7 of the light source unit 30A, the right light-emitting element 30B2 of the light source unit 30B and the right light-emitting element 30C2 of the light source unit 30C are connected in series. The wiring channel ch4 (an example of the first-type wiring channel) is configured as a wiring channel only for the left light-emitting element 30C1 of the light source unit 30C.

Figure 5:
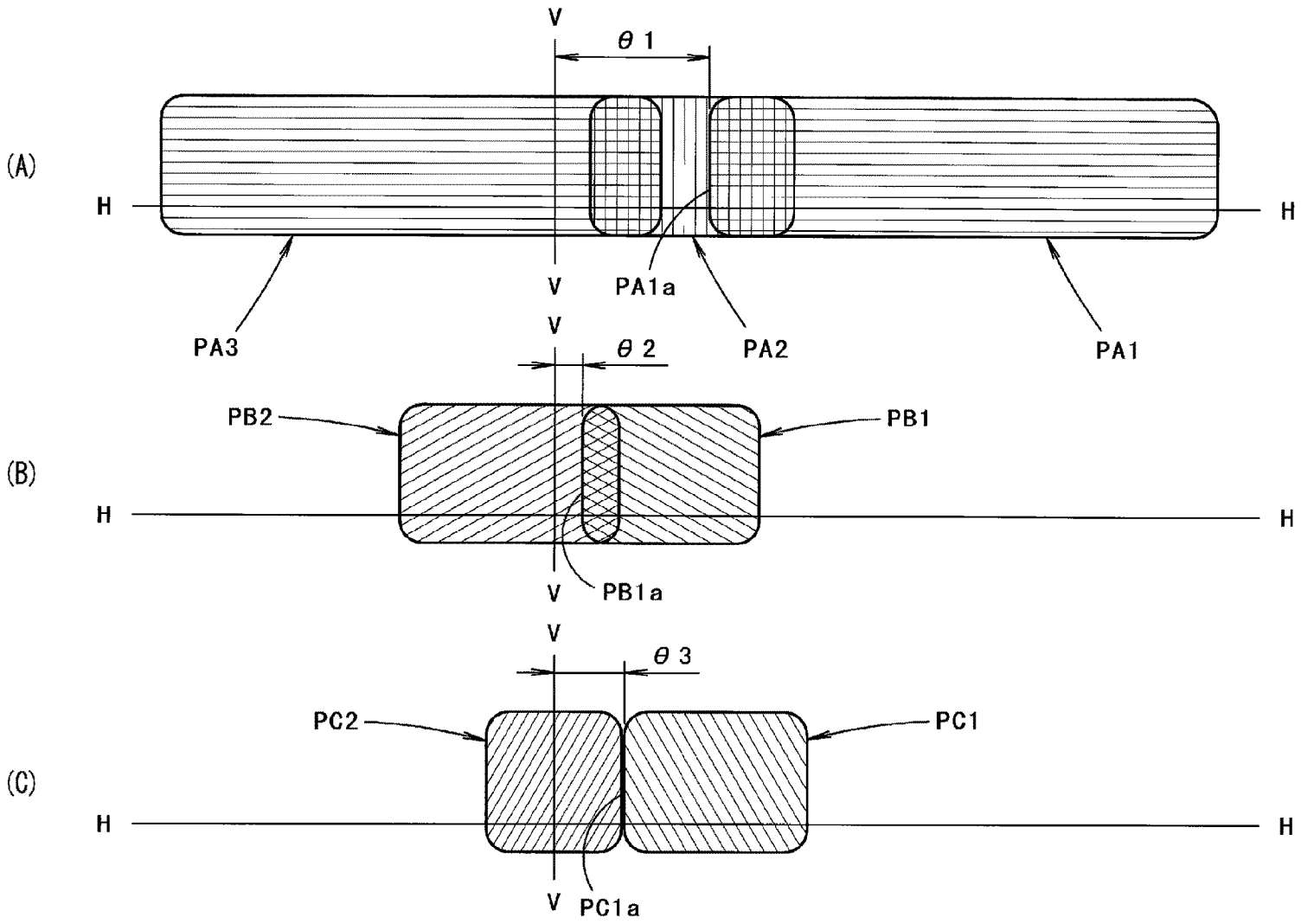
FIG. 5 depicts light distribution patterns, which are to be formed on a virtual vertical screen arranged at a position of 25 m ahead of the vehicle lamp by illumination light from each lamp unit in accordance with the first illustrative embodiment.

FIG. 5 depicts light distribution patterns, which are to be formed on a virtual vertical screen arranged at a position of 25 m ahead of the lamp by illumination light from each of the lamp units 20A, 20B, 20C.

Three light distribution patterns PA1, PA2, PA3 shown in FIG. 5A are light distribution patterns that are to be formed by the illumination light from the lamp unit 20A.

The light distribution pattern PA2 is a light distribution pattern that is to be formed when the central light-emitting element 30A4 is turned on. The light distribution pattern PA2 is formed as a light distribution pattern that is slightly laterally long at a position slightly distant rightward from a V-V line perpendicularly passing a vanishing point ahead of the lamp.

The light distribution pattern PA is a light distribution pattern that is to be formed when the left three light-emitting elements 30A1 to 30A3 are tuned on at the same time. The light distribution pattern PA1 is formed as a light distribution pattern that is laterally long at a further rightward position than the light distribution pattern PA2, and a left end portion thereof is superimposed on the additive light distribution pattern PA2.

The light distribution pattern PA3 is a light distribution pattern that is to be formed when the right three light-emitting elements 30A5 to 30A7 are tuned on at the same time. The light distribution pattern PA3 is formed as a light distribution pattern that is laterally long and crosses the V-V line at a further leftward position than the light distribution pattern PA2, and a right end portion thereof is superimposed on the additive light distribution pattern PA2.

The three light distribution patterns PA1, PA2, PA3 are formed to have substantially the same width in an upper and lower direction. At this time, lower end edges of the three light distribution patterns PA1, PA2, PA3 are located slightly below (for example, located on the order of 1 below) an H-H line passing the vanishing point in the horizontal direction, and upper end edges thereof are located somewhat above the H-H line (for example, located on the order of 5° above).

The three light distribution patterns PA1, PA2, PA3 are formed as a light distribution pattern that is considerably laterally long, as a whole. The reason is that the seven light-emitting elements 30A1 to 30A7 are widely arranged in the right and left direction. Since the six light-emitting elements 30A1 to 30A3, 30A5 to 30A7 positioned at both sides of the light-emitting element 30A4 positioned at the focus F1 of the reflective surface 40Aa are arranged so that a light-emitting element located at a more distant position from the light-emitting element 30A4 is located at a position deviating more forward from the light-emitting element 30A4, each lower end edge of the light distribution patterns PA1, PA2, PA3 is formed to extend in the substantially horizontal direction.

The light distribution patterns PA1, PA2, PA3 are formed as reverted projected images of the light-emitting elements 30A1 to 30A3, 30A4, 30A5 to 30A7 slightly enlarged in the horizontal direction by the reflector 40A. Each of both right and left end edges of the light distribution patterns PA1, PA2, PA3 configures a light-dark boundary extending vertically. A shape of the plurality of reflection elements 40As configuring the reflective surface 40Aa is set so that a left end edge PA1*a* of the light distribution pattern PA1 is formed as a clear light-dark boundary. The left end edge PA1*a* of the light distribution pattern PA is arranged at a position of an angle θ1 (for example, θ1=6°) from the V-V line.

Two light distribution patterns PB1, PB2 shown in FIG. 5B are light distribution patterns that are to be formed by the illumination light from the lamp unit 20B.

The light distribution pattern PB1 is a light distribution pattern that is to be formed when the left light-emitting element 30B1 is turned on. The light distribution pattern PB1 is formed as a light distribution pattern that is slightly laterally long at a position slightly distant rightward from the V-V line.

The light distribution pattern PB2 is a light distribution pattern that is to be formed when the right light-emitting element 30B2 is turned on. The light distribution pattern PB2 is formed as a light distribution pattern that is slightly laterally long and crosses the V-V line at a further leftward position than the light distribution pattern PB1, and a right end portion thereof is superimposed on the additive light distribution pattern PB1.

The light distribution patterns PB1, PB2 are formed as reverted projected images of the light-emitting elements 30B1, 30B2 slightly extended in the horizontal direction by the reflector 40B. Each of both right and left end edges of the light distribution patterns PB1, PB2 configures a light-dark boundary extending vertically. A shape of the plurality of reflection elements 40Bs configuring the reflective surface 40Ba is set so that a left end edge PB1*a* of the light distribution pattern PB1 is formed as a clear light-dark boundary. The left end edge PB1*a* of the light distribution pattern PB1 is arranged at a position of an angle θ2 (for example, θ2=1.5°) from the V-V line, which is considerably smaller than the angle θ1.

Two light distribution patterns PC1, PC2 shown in FIG. 5C are light distribution patterns that are to be formed by the illumination light from the lamp unit 20C.

The light distribution pattern PC1 is a light distribution pattern that is to be formed when the left light-emitting element 30C1 is turned on. The light distribution pattern PC1 is formed as a light distribution pattern that is slightly laterally long at a position slightly distant rightward from the V-V line.

The light distribution pattern PC2 is to be formed when the right light-emitting element 30C2 is turned on. The light distribution pattern PC2 is formed as a light distribution pattern having a substantially rectangular shape crossing the V-V line at a further leftward position than the light distribution pattern PC1, and a right end portion thereof is superimposed on the additive light distribution pattern PC1.

The light distribution patterns PC1, PC2 are formed as reverted projected images of the light-emitting elements 30C1, 30C2 slightly extended in the horizontal direction by the reflector 40C. Each of both right and left end edges of the light distribution patterns PC1, PC2 configures a light-dark boundary extending vertically. A shape of the plurality of reflection elements 40Cs configuring the reflective surface 40Ca is set so that a left end edge PC1*a* of the light distribution pattern PC1 is formed as a clear light-dark boundary. The left end edge PC1*a* of the light distribution pattern PC1 is arranged at a position of an angle θ3 (for example, θ2=3°) from the V-V line, which is slightly greater than the angle θ2.

Figure 6:
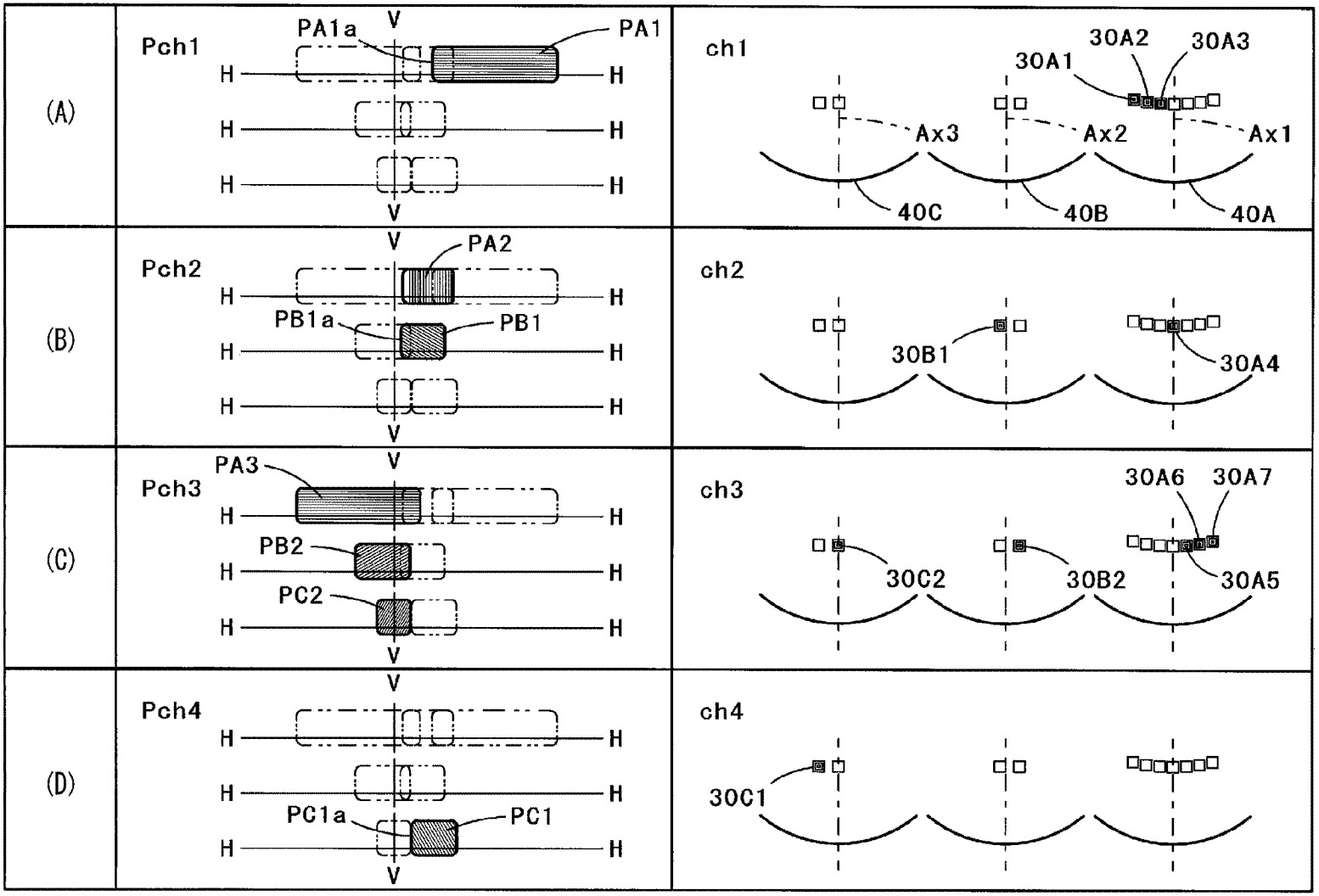
FIG. 6 depicts four types of light distribution patterns, which are to be formed when turning on light source units of three lamp units in accordance with the first illustrative embodiment through respective wiring channels.

FIG. 6 depicts four types of light distribution patterns Pch1 to Pch4, which are to be formed when turning on the three light source units 30A, 30B, 30C through the respective wiring channels ch1 to ch4.

The light distribution pattern Pch1 (an example of the first-type light distribution pattern) shown in FIG. 6A is formed only by the light distribution pattern PA1 that is to be formed when power is supplied to the wiring channel ch1 (i.e., the light-emitting elements 30A1 to 30A3 are turned on). In the light distribution pattern Pch1, the left end edge PA1*a* of the light distribution pattern PA1 is formed as a clear light-dark boundary.

The light distribution pattern Pch2 (an example of the second-type light distribution pattern) shown in FIG. 6B is formed by the light distribution patterns PA2, PB1, which are to be formed when power is supplied to the wiring channel ch2 (i.e., the light-emitting elements 30A4, 30B1 are turned on). In the light distribution pattern Pch2, the left end edge PB1*a* of the light distribution pattern PB1 is formed as a clear light-dark boundary.

The light distribution pattern Pch3 (an example of the second-type light distribution pattern) shown in FIG. 6C is formed by the light distribution patterns PA3, PB2, PC2, which are to be formed when power is supplied to the wiring channel ch3 (i.e., the light-emitting elements 30A5 to 30A7, 30B2, 30C2 are turned on).

The light distribution pattern Pch4 (an example of the first-type light distribution pattern) shown in FIG. 6D is formed only by the light distribution pattern PC1, which is to be formed when power is supplied to the wiring channel ch4 (i.e., the light-emitting element 30C1 is turned on). In the light distribution pattern Pch4, the left end edge PC1*a* of the light distribution pattern PC1 is formed as a clear light-dark boundary.

Figure 7:
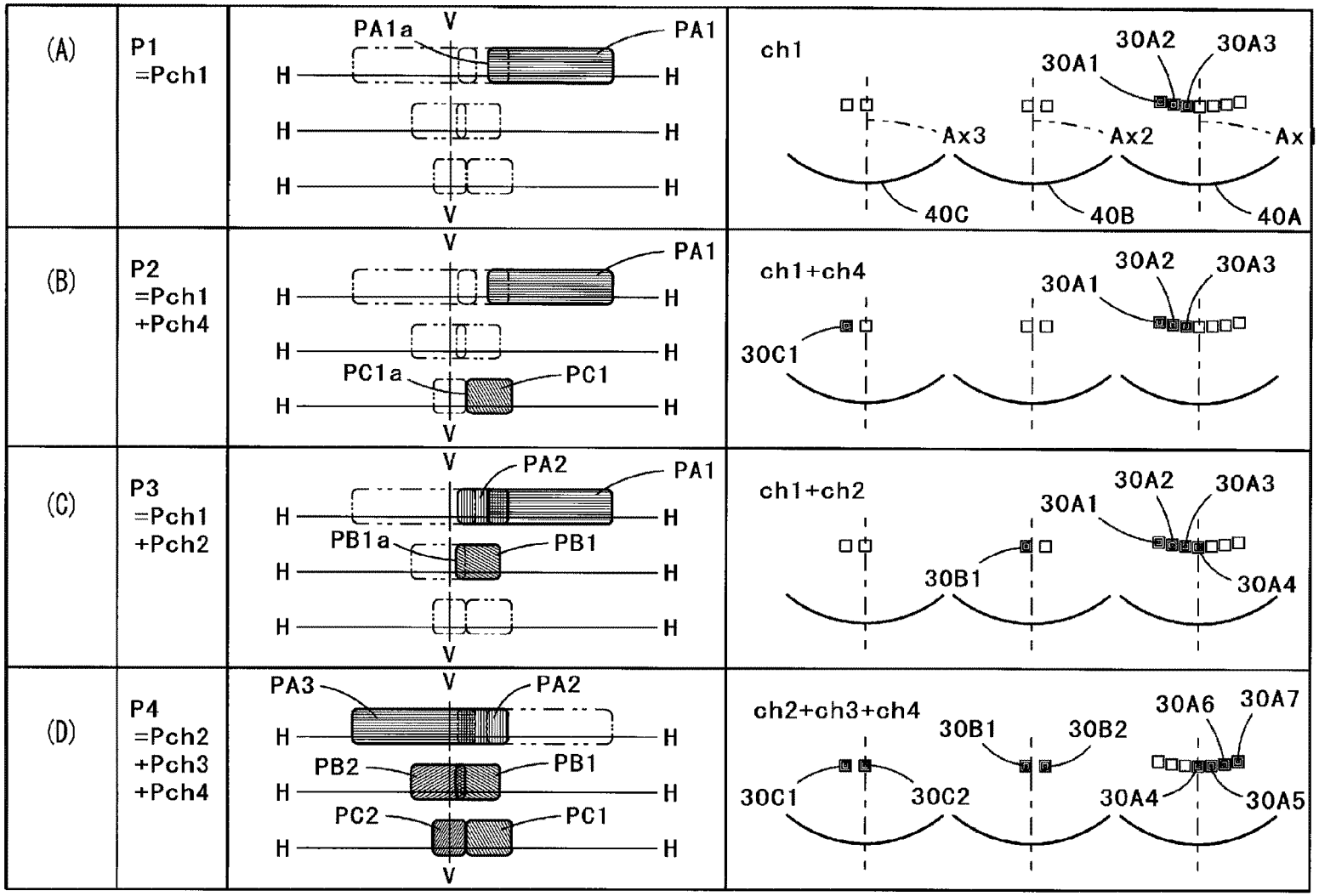
FIG. 7 depicts four additive light distribution patterns, which are to be formed when turning on the three light source units in accordance with the first illustrative embodiment by an appropriate combination of four wiring channels.

FIG. 7 depicts four additive light distribution patterns P1 to P4, which are to be formed when turning on the three light source units 30A, 30B, 30C by an appropriate combination of the four wiring channels ch1 to ch4.

The additive light distribution pattern P1 shown in FIG. 7A is configured only by the light distribution pattern PA1, which is to be formed when power is supplied to the wiring channel ch1 (i.e., the light-emitting elements 30A1 to 30A3 are turned on).

The additive light distribution pattern P2 shown in FIG. 7B is configured by the light distribution patterns PA1, PC1, which are to be formed when power is supplied to the wiring channels ch1, ch2 (i.e., the light-emitting elements 30A1 to 30A3, 30C1 are turned on).

The additive light distribution pattern P3 shown in FIG. 7C is configured by the light distribution patterns PA1, PA2, which are to be formed when power is supplied to the wiring channels ch1, ch2 (i.e., the light-emitting elements 30A1 to 30A3, 30B1 are turned on).

The additive light distribution pattern P4 shown in FIG. 7D is configured by the light distribution patterns PA2, PA3, PB1, PB2, PC1, PC2, which are to be formed when power is supplied to the wiring channels ch2, ch3, ch4 (i.e., the light-emitting elements 30A4 to 30A7, 30B1, 30B2, 30C1, 30C2 are turned on).

Figure 8:
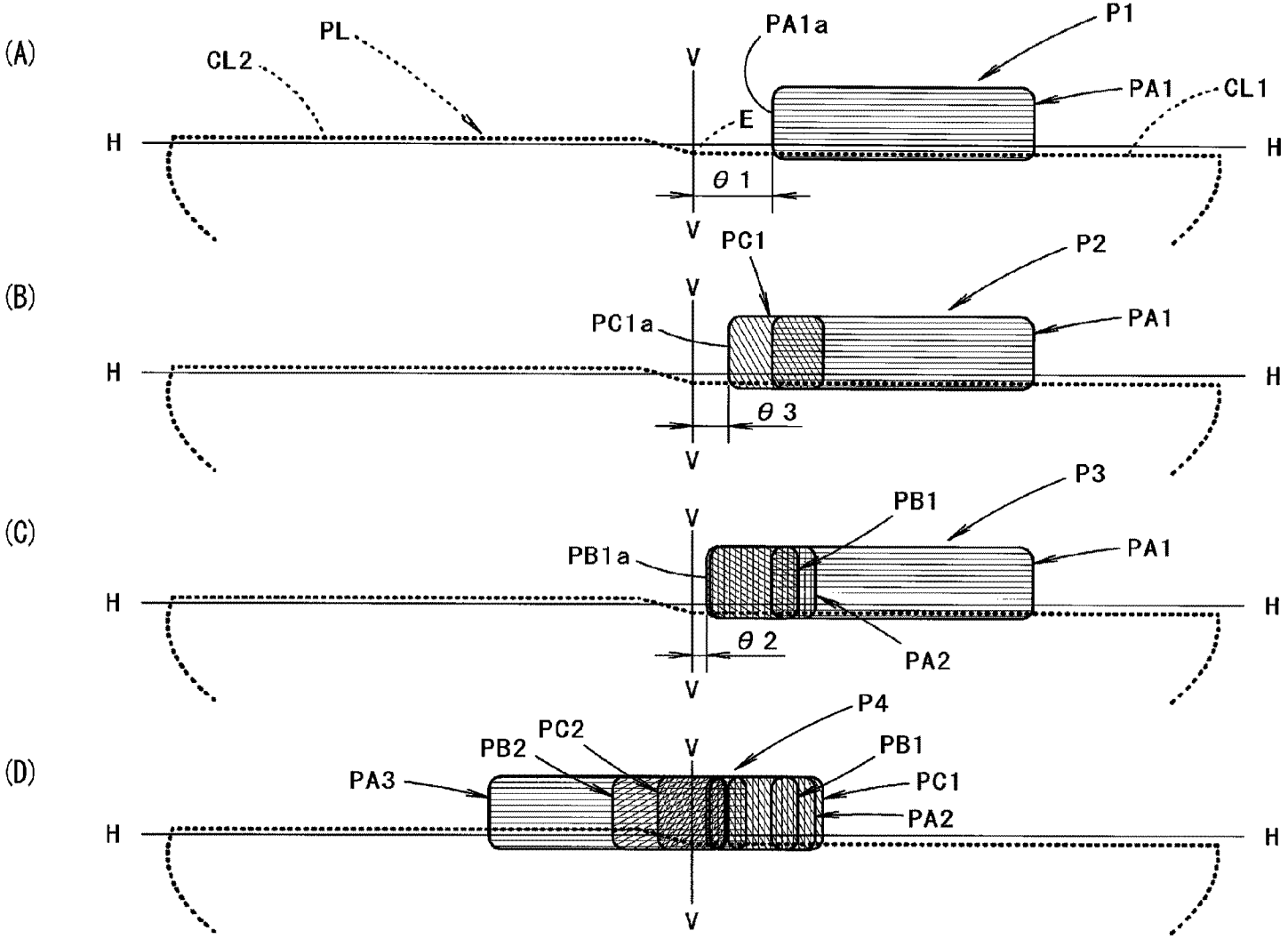
FIG. 8 depicts four additive light distribution patterns in accordance with the first illustrative embodiment with being superimposed on a light distribution pattern for low beam.

FIG. 8 depicts the four additive light distribution patterns P1 to P4 with being superimposed on a light distribution pattern for low beam PL, which is to be formed by illumination light from another vehicle lamp (not shown).

The light distribution pattern for low beam PL has cut-off lines CL1, CL2 at an upper end edge thereof. The cut-off lines CL1, CL2 extend in the horizontal direction at different positions in the upper and lower direction on the basis of the V-V line. A right oncoming traffic lane-side part of the V-V line is formed as a lower end cut-off line CL1. A left own traffic lane-side part of the V-V line is formed as an upper end cut-off line CL2. The lower end cut-off line CL1 and the upper end cut-off line CL2 are connected by an inclined part.

In the light distribution pattern for low beam PL, an elbow point E, which is an intersection point of the lower end cut-off line CL1 and the V-V line, is located on order of 0.5 to 0.6° below an intersection point of the H-H line and the V-V line.

The additive light distribution pattern P1 is formed so that a lower end portion thereof overlaps with the lower end cut-off line CL1. In the additive light distribution pattern P1, the left end edge PA1*a* formed as a clear light-dark boundary extends upward from the lower end cut-off line CL1 at a position of the angle θ1.

The additive light distribution pattern P2 is formed so that a lower end portion thereof overlaps with the lower end cut-off line CL1. In the additive light distribution pattern P2, the left end edge PC1*a* formed as a clear light-dark boundary extends upward from the lower end cut-off line CL1 at a position of the angle θ3. Since the additive light distribution pattern P2 is formed with the light distribution patterns PA1, PC1 being superimposed, a part close to the left end edge PC1*a* is bright.

The additive light distribution pattern P3 is formed so that a lower end portion thereof overlaps with the lower end cut-off line CL1. In the additive light distribution pattern P3, the left end edge PB1*a* formed as a clear light-dark boundary extends upward from the lower end cut-off line CL1 at a position of the angle θ2. Also, since the additive light distribution pattern P3 is formed with the light distribution patterns PA1, PA2, PB1 being superimposed, a part close to the left end edge PB1*a* is brighter.

The additive light distribution pattern P4 is formed so that a lower end portion overlaps with the lower end cut-off line CL1 and the upper end cut-off line CL2. Since the additive light distribution pattern P4 is formed with the light distribution patterns PA2, PA3, PB1, PB2, PC1, PC2 being superimposed, a region adjacent to the V-V line is very bright.

In the below, operational effects of the first illustrative embodiment are described.

In the vehicle lamp 10 of the first illustrative embodiment, the wirings of the plurality of light-emitting elements 30A1 to 30A7, 30B1, 30B2, 30C1, 30C2 included in the three lamp units 20A, 20B, 20C are grouped into the four wiring channels ch1 to ch4. When the power is supplied to at least one of the wiring channels ch1 to ch4 to selectively turn on the plurality of light-emitting elements 30A1 to 30A7, 30B1, 30B2, 30C1, 30C2, the four types of light distribution patterns Pch1 to Pch4 in which the positions of the light-dark boundaries extending in the upper and lower direction are different are formed. Therefore, even though the plurality of lamp units is provided, it is possible to suppress an increase in the number of wiring channels. Thereby, it is possible to simplify a configuration of the lighting control circuit and to easily detect a breaking or a short of each of the wiring channels ch1 to ch4, so that it is possible to suppress the cost increase.

Like this, according to the first illustrative embodiment, even though the plurality of lamp units 20A, 20B, 20C configured to use the light-emitting elements 30A1 to 30A7, 30B1, 30B2, 30C1, 30C2 as a light source is provided, it is possible to form the plurality of types of light distribution patterns Pch1 to Pch4, in which the positions of the light-dark boundaries extending in the upper and lower direction are different, by the inexpensive configuration.

Also, in the first illustrative embodiment, the lighting and lights-out are controlled by appropriately combining the four wiring channels ch1 to ch4. Thereby, the four additive light distribution pattern P1 to P4, in which the positions of the light-dark boundaries extending in the upper and lower direction are different, are configured to be selectively superimposed on the light distribution pattern for low beam PL. As a result, following operational effects can be achieved.

The left end edges PA1*a*, PB1*a*, PC1*a* of the three light distribution patterns Pch1, Pch2, Pch3 are formed as the clear light-dark boundaries. Therefore, when any one of the three additive light distribution patterns P1 to P3 is superimposed on the light distribution pattern for low beam PL, it is possible to widely illuminate the forward traveling road by the illumination light from the vehicle lamp 10 without causing the glare to a driver of a forward traveling vehicle or an oncoming vehicle.

Also, when the additive light distribution pattern P4 is superimposed on the light distribution pattern for low beam PL, the region adjacent to the V-V line becomes very bright, so that it is possible to sufficiently secure the far-field visibility.

In the first illustrative embodiment, the shapes and brightness of the four types of light distribution patterns Pch1 to Pch4 are different. Therefore, it is possible to improve degrees of freedom of the shapes, the maximum light intensity and the light intensity distributions of the additive light distribution patterns P1 to P4 that are to be formed by an appropriate combination of the light distribution patterns.

In the first illustrative embodiment, the distance in the vehicle width direction between the optical axis Ax1 of the lamp unit 20A and the arrangement center of the plurality of light-emitting elements 30A1 to 30A7, the distance in the vehicle width direction between the optical axis Ax2 of the lamp unit 20B and the arrangement center of the plurality of light-emitting elements 30B1, 30B2, and the distance in the vehicle width direction between the optical axis Ax3 of the lamp unit 20C and the plurality of light-emitting elements 30C1, 30C2 are different. Therefore, it is possible to easily form the four types of light distribution patterns Pch1 to Pch4 in which the positions of the light-dark boundaries extending in the upper and lower direction are different.

In the first illustrative embodiment, the arrangement interval of the light-emitting elements 30A1 to 30A7 of the lamp unit 20A, the arrangement interval of the light-emitting elements 30B1, 30B2 of the lamp unit 20B, and the arrangement interval of the light-emitting elements 30C1, 30C2 of the lamp unit 20C are different. Also by this feature, it is possible to easily form the four types of light distribution patterns Pch1 to Pch4 in which the positions of the light-dark boundaries extending in the upper and lower direction are different.

In the first illustrative embodiment, the number of the light-emitting elements 30A1 to 30A7 of the lamp unit 20A is different from the number of the light-emitting elements 30B1, 30B2 of the lamp unit 20B and the number of the light-emitting elements 30C1, 30C2 of the lamp unit 20C. Therefore, it is possible to easily form the four types of light distribution pattern Pch1 to Pch4 having different sizes.

In the first illustrative embodiment, the head lamp that is to be arranged at the right front end portion of the vehicle has been exemplified as the vehicle lamp 10. However, the vehicle lamp 10 may also be configured as a head lamp that is to be arranged at a left front end portion of the vehicle.

Figure 9:
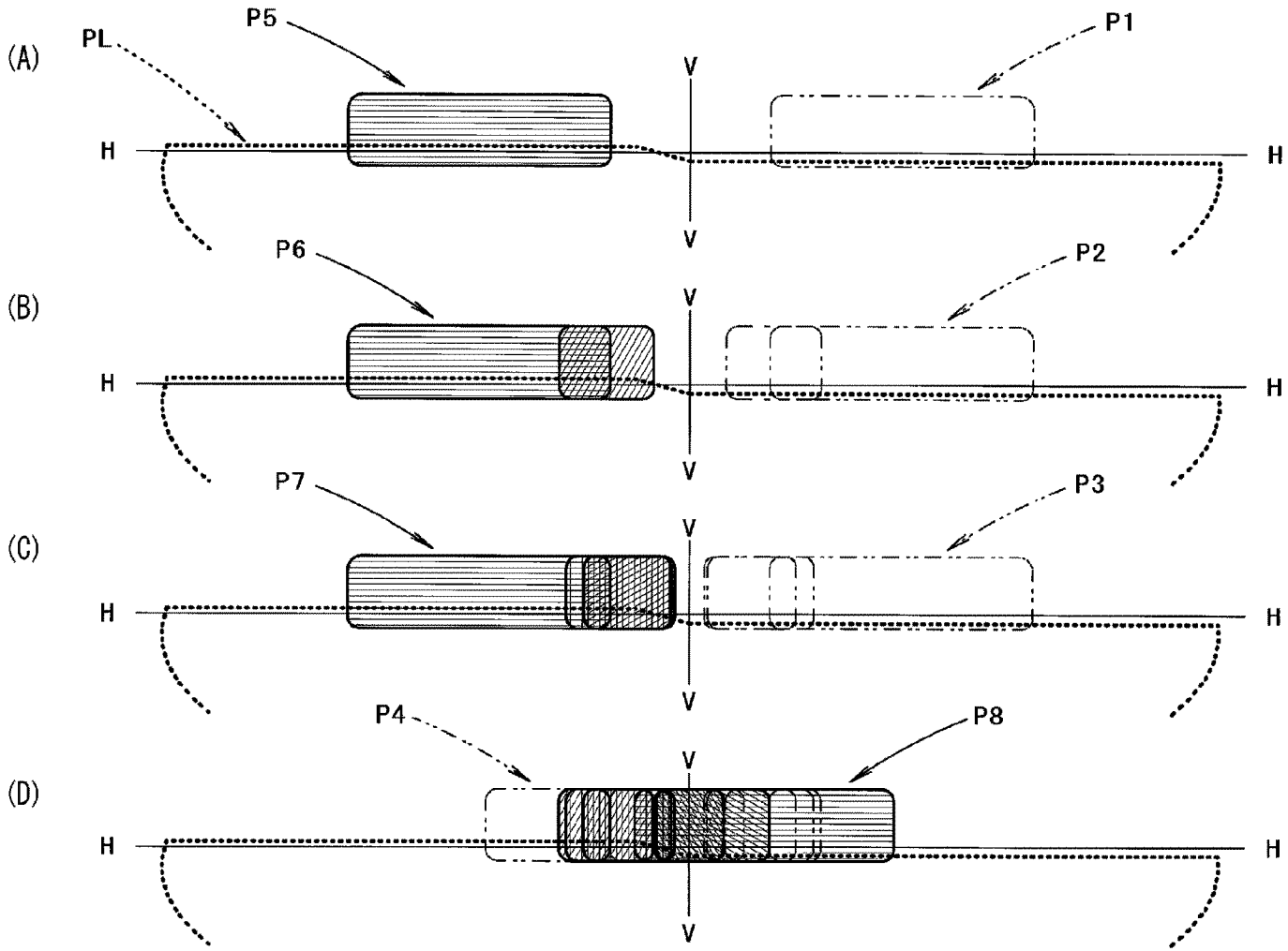
FIG. 9 depicts four additive light distribution patterns, which are to be formed by illumination light from a vehicle lamp having a bilaterally symmetric configuration with respect to the vehicle lamp of the first illustrative embodiment, with being superimposed on the light distribution pattern for low beam.

FIG. 9 depicts four additive light distribution patterns P5 to P8, which are to be formed by illumination light from a vehicle lamp (not shown) having a bilaterally symmetric configuration with respect to the vehicle lamp 10, with being superimposed on the light distribution pattern for low beam PL.

The four additive light distribution patterns P5 to P8 are formed at positions, which are bilaterally symmetric to the four additive light distribution patterns P1 to P4 with respect to the V-V line. When the eight additive light distribution patterns P1 to P8 are appropriately combined as a whole of the vehicle, following operational effects can be accomplished.

That is, when the six additive light distribution patterns P1 to P3, P5 to P7 are appropriately combined to be superimposed on the light distribution pattern for low beam PL, it is possible to widely illuminate the forward traveling road without causing the glare to a driver of a forward traveling vehicle or an oncoming vehicle.

Also, when the two additive light distribution patterns P4, P8 are combined to be partially superimposed, it is possible to form a light distribution pattern that is laterally long and is very bright in the region adjacent to the V-V line. When the two additive light distribution patterns are superimposed on the light distribution pattern for low beam PL, it is possible to form a light distribution pattern for high beam in which the far-field visibility is improved.

In the first illustrative embodiment, the light distribution patterns, which are to be formed by combining the four types of light distribution patterns Pch1 to Pch4, have been described as the additive light distribution patterns P1 to P4 that are to be added to the light distribution pattern for low beam PL. However, the four types of light distribution patterns Pch1 to Pch4 may also be formed as light distribution patterns that are not on the premise of addition to the light distribution pattern for low beam PL.

Subsequently, modified embodiments of the first illustrative embodiment are described.

First, a first modified embodiment of the illustrative embodiment is described.

Figure 10:
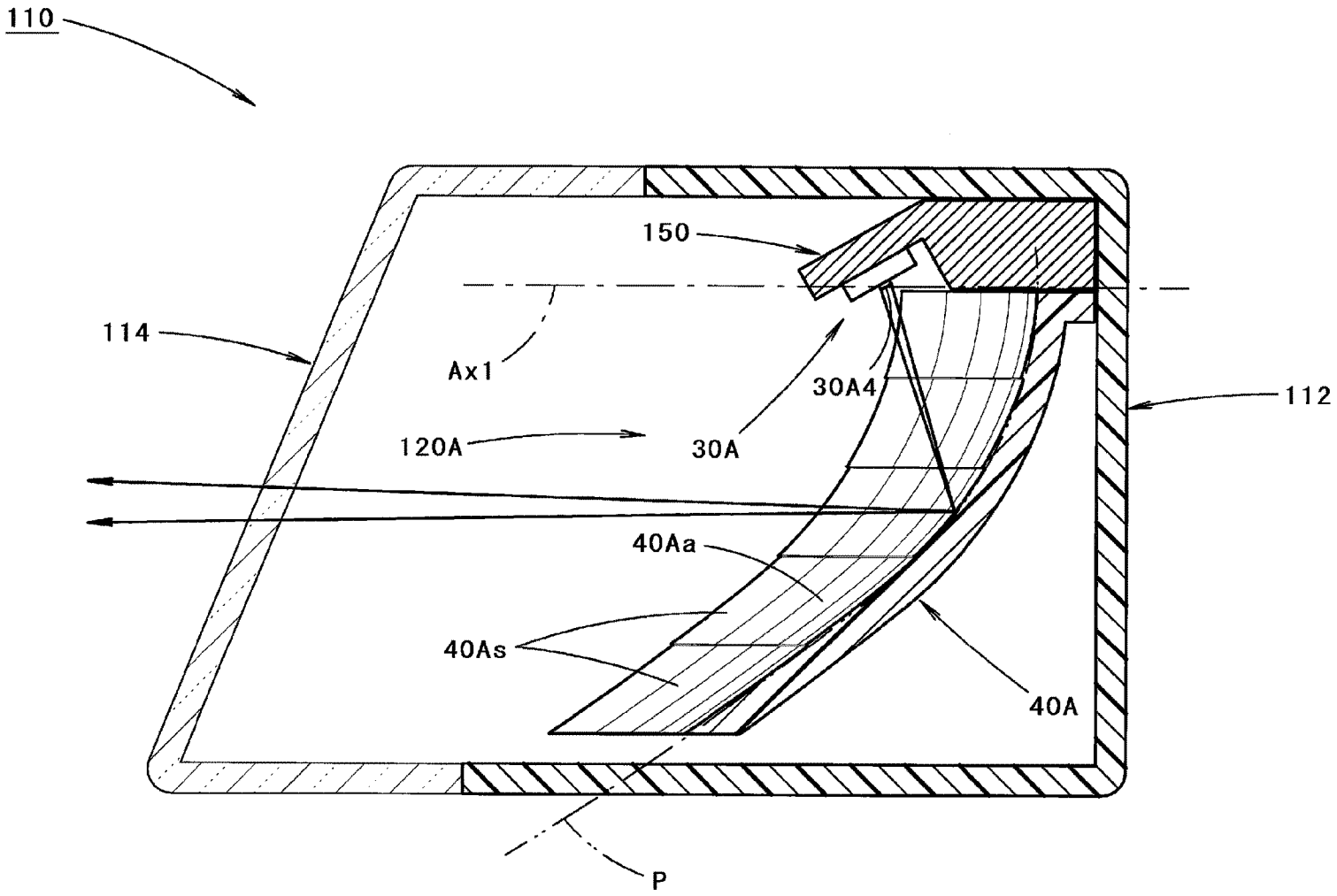
FIG. 10 is a view similar to FIG. 3, depicting a vehicle lamp in accordance with a first modified embodiment of the first illustrative embodiment.

FIG. 10 is a view similar to FIG. 3, depicting a vehicle lamp 110 in accordance with the first modified embodiment.

Although the basic configuration of the vehicle lamp 110 is similar to the vehicle lamp 10 of the first illustrative embodiment, a direction of a light source unit 30A of a lamp unit 120A thereof is different.

That is, in the first modified embodiment, the light-emitting element 30A4 and the like configuring the light source unit 30A of the lamp unit 120A are arranged with the light-emitting surfaces thereof facing obliquely downward toward the rear. Accompanied by this, the shapes of the support member 150, the lamp body 112 and the translucent cover 114 are different from the first illustrative embodiment.

By adopting the configuration of the first modified embodiment, it is possible to enable the more emission light from the light-emitting element 30A4 and the like to reach the reflective surface 40Aa of the reflector 40A, so that it is possible to improve the illumination efficiency.

In the meantime, when the two lamp units except for the lamp unit 120A are also configured to have the similar configuration, it is possible to further improve the illumination efficiency.

Subsequently, a second modified embodiment of the first illustrative embodiment is described.

Figure 11:
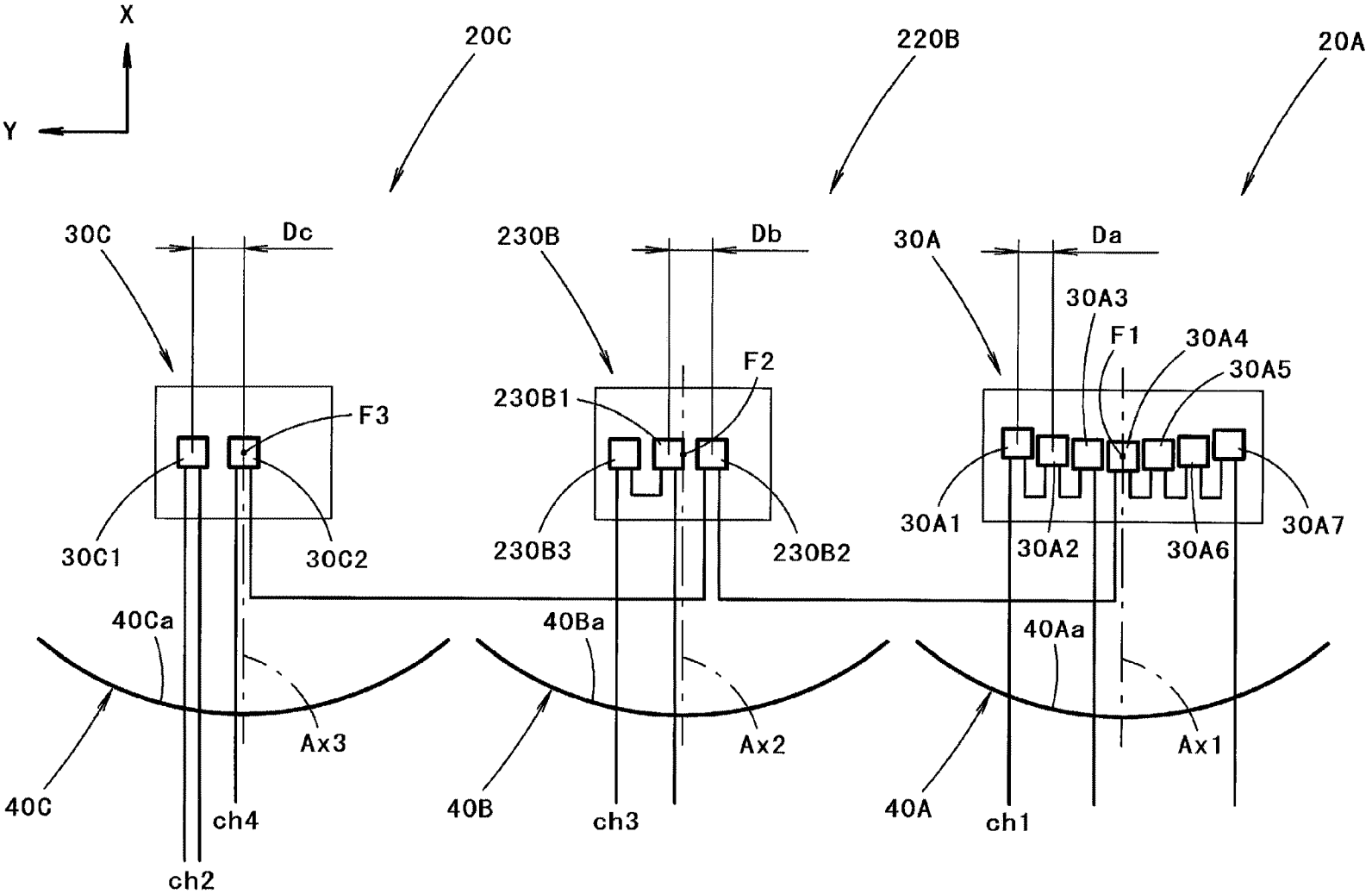
FIG. 11 is a view similar to FIG. 4, depicting a part of a vehicle lamp in accordance with a second modified embodiment of the first illustrative embodiment.

FIG. 11 is a view similar to FIG. 4, depicting a main part of a vehicle lamp in accordance with the second modified embodiment.

Although the basic configuration of the second modified embodiment is similar to the first illustrative embodiment, a configuration of a light source unit 230B of a lamp unit 220B and a configuration of the four wiring channels ch1 to ch4 are different from the first illustrative embodiment.

In the second modified embodiment, the light source unit 230B has three light-emitting elements 230B1, 230B2, 230B3.

A configuration and an arrangement of the two light-emitting elements 230B1, 230B2 of the three light-emitting elements 230B1, 230B2, 230B3 are similar to the two light-emitting elements 30B1, 30B2 configuring the light source unit 30B of the first illustrative embodiment, and the remaining one light-emitting element 230B3 is located at a position slightly distant leftward from the light-emitting element 230B1. The light-emitting element 230B3 and the light-emitting element 230B2 are arranged at positions of an equal distance from the light-emitting element 230B1, and a configuration of the light-emitting element 230B3 is similar to the light-emitting element 230B1.

In the second modified embodiment, the left three light-emitting elements 30A1 to 30A3 of the light source unit 30A are connected in series to the wiring channel ch1 (an example of the first-type wiring channel) of the four wiring channels ch1 to ch4, like the first illustrative embodiment. However, the remaining three wiring channels ch2 to ch4 have configurations different from the first illustrative embodiment.

The wiring channel ch2 (an example of the first-type wiring channel) is configured as a wiring channel only for the left light-emitting element 30C1 of the light source unit 30C. The wiring channel ch3 (an example of the first-type wiring channel) is configured as a wiring channel to which the left two light-emitting elements 230B1, 230B3 of the light source unit 230B are connected in series. The wiring channel ch4 (an example of the second-type wiring channel) is configured as a wiring channel to which the right four light-emitting elements 30A4 to 30A7 of the light source unit 30A, the right end light-emitting element 230B2 of the light source unit 230B and the right light-emitting element 30C2 of the light source unit 30C are connected in series.

Figure 12:
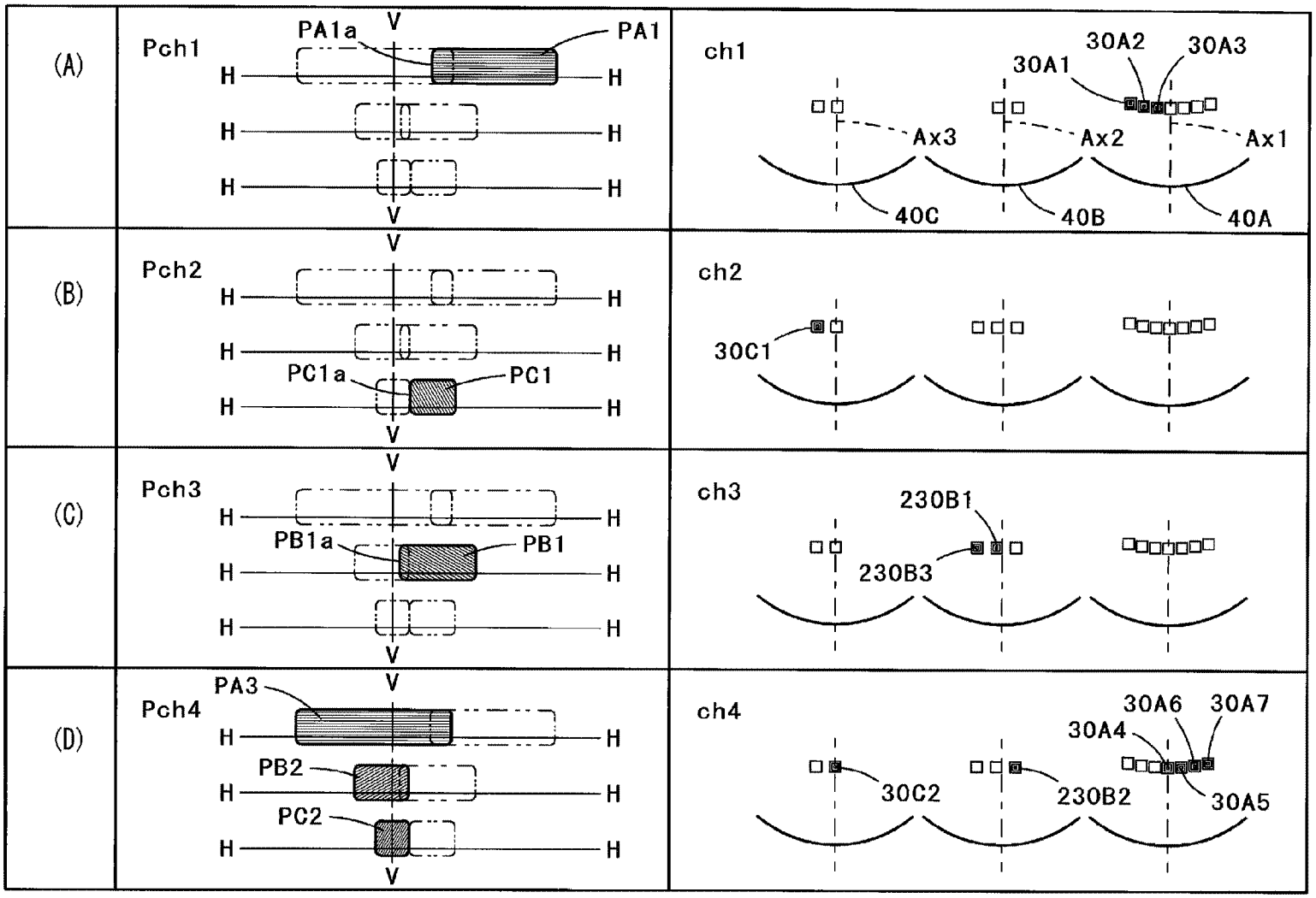
FIG. 12 is a view similar to FIG. 6, depicting operations of the second modified embodiment.

FIG. 12 depicts the four types of light distribution patterns Pch1 to Pch4, which are to be formed when the three light source units 30A, 230B, 30C are turned on through the respective wiring channels ch1 to ch4, in the second modified embodiment.

The light distribution pattern Pch1 (an example of the first-type light distribution pattern) shown in FIG. 12A is configured only by the light distribution pattern PA1, which is to be formed when the power is supplied to the wiring channel ch1 (i.e., the light-emitting elements 30A1 to 30A3 are tuned on). In the light distribution pattern Pch1, the left end edge PA1*a* of the light distribution pattern PA is formed as a clear light-dark boundary.

The light distribution pattern Pch2 (an example of the first-type light distribution pattern) shown in FIG. 12B is configured only by the light distribution pattern PC1, which is to be formed when the power is supplied to the wiring channel ch2 (i.e., the light-emitting element 30C1 is tuned on). In the light distribution pattern Pch2, the left end edge PC1*a* of the light distribution pattern PC is formed as a clear light-dark boundary.

The light distribution pattern Pch3 (an example of the first-type light distribution pattern) shown in FIG. 12C is configured only by the light distribution pattern PB1, which is to be formed when the power is supplied to the wiring channel ch3 (i.e., the light-emitting elements 230B1, 230B3 are tuned on). In the light distribution pattern Pch3, the left end edge PB1*a* of the light distribution pattern PB1 is formed as a clear light-dark boundary.

The light distribution pattern Pch4 (an example of the second-type light distribution pattern) shown in FIG. 12D is configured by the light distribution patterns PA3, PB2, PC2, which are to be formed when the power is supplied to the wiring channel ch4 (i.e., the light-emitting elements 30A4 to 30A7, 230B2, 30C2 are tuned on).

Also with the configuration of the second modified embodiment, when the power is supplied to at least one of the wiring channels ch1 to ch4 to selectively turn on the plurality of light-emitting elements 30A1 to 30A7, 230B1 to 230B3, 30C1, 30C2, the four types of light distribution pattern Pch1 to Pch4 in which the positions of the light-dark boundaries extending in the upper and lower direction are different are formed. Thereby, it is possible to accomplish the operational effects similar to the first illustrative embodiment.

Also, in the second modified embodiment, the four types of light distribution patterns Pch1 to Pch4 can be used as the light distribution patterns equivalent to the four additive light distribution patterns P1 to P4 of the first illustrative embodiment.

Subsequently, a third modified embodiment of the first illustrative embodiment is described.

Figure 13:
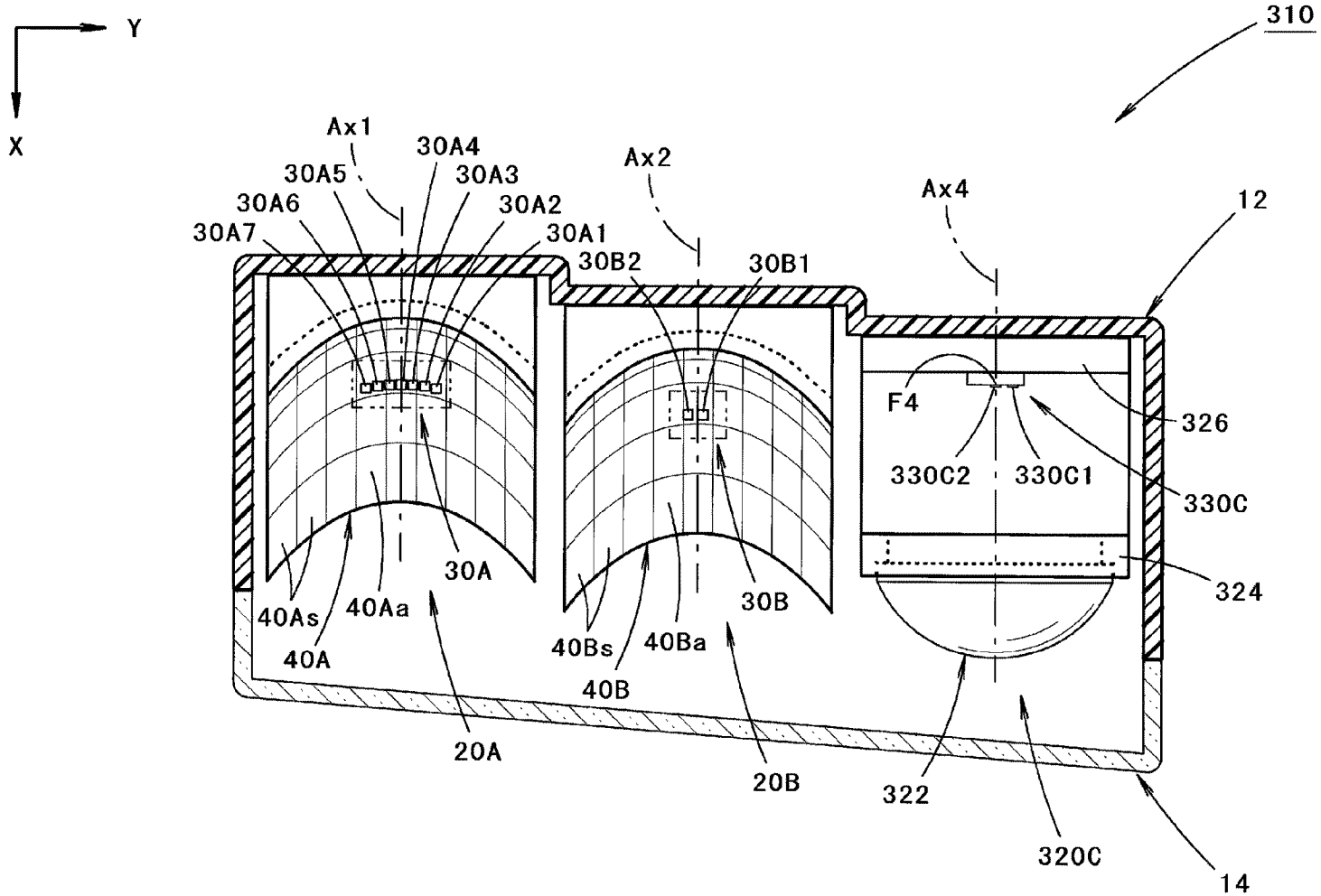
FIG. 13 is a view similar to FIG. 2, depicting a vehicle lamp in accordance with a third modified embodiment of the first illustrative embodiment.

FIG. 13 is a view similar to FIG. 2, depicting a vehicle lamp 310 in accordance with the third modified embodiment.

As shown in FIG. 13, although the basic configuration of the vehicle lamp 310 is similar to the vehicle lamp 10 of the first illustrative embodiment, it is different from the first illustrative embodiment, in that a lamp unit 320C is arranged instead of the lamp unit 20C of the first illustrative embodiment.

In the third modified embodiment, the lamp unit 320C is configured as a projector-type lamp unit, not the reflector unit.

The lamp unit 320C includes a projector lens 322 having an optical axis Ax4 extending in the front and back direction of the vehicle, and a light source unit 330C arranged at the rear of the projector lens 322, and is configured to illuminate forward the emission light from the light source unit 330C via the projector lens 322.

The projector lens 322 is a plane-convex aspherical lens of which a front surface is a convex surface and a rear surface is a planar surface, and is supported at its outer peripheral edge portion to a lens holder 324. The projector lens 322 is configured to project, as a reverted image, a light source image that is to be formed on a rear focal plane thereof (i.e., a focal plane including a rear focus F4 of the projector lens 322), on the virtual vertical screen ahead of the lamp.

The light source unit 330C includes two light-emitting elements 330C1, 330C2 aligned in the right and left direction, and is supported to a support member 326 with a light-emitting surface thereof facing forward.

The two light-emitting elements 330C1, 330C2 have the configuration similar to the light-emitting element 30C1, 30C2 of the first illustrative embodiment. The light-emitting element 330C2 of the two light-emitting elements 330C1, 330C2 is arranged at a position slightly deviating in the front and back direction with respect to the rear focus F4 of the projector lens 322. The light-emitting element 330C1 is arranged at a position slightly distant leftward from the light-emitting element 330C2.

Thereby, a light distribution pattern, which is substantially similar to the light distribution pattern PC2 shown in FIG. 5C, is formed as a reverted projected image of the light-emitting surface of the light-emitting element 330C2, and a light distribution pattern, which is substantially similar to the light distribution pattern PC1 shown in FIG. 5C, is formed as a reverted projected image of the light-emitting surface of the light-emitting element 330C1.

Also in the third modified embodiment, the wirings of the plurality of light-emitting elements 30A1 to 30A7, 30B1, 30B2, 330C1, 330C2 included in the three lamp units 20A, 20B, 320C are grouped into the four wiring channels ch1 to ch4 similar to the first illustrative embodiment.

Also with the configuration of the third modified embodiment, when the power is supplied to at least one of the wiring channels ch1 to ch4 to selectively turn on the plurality of light-emitting elements 30A1 to 30A7, 30B1,

30B2, 330C1, 330C2, the four types of light distribution patterns in which the positions of the light-dark boundaries extending in the upper and lower direction are different are formed. Thereby, it is possible to accomplish the operational effects similar to the first illustrative embodiment.

Figure 14:
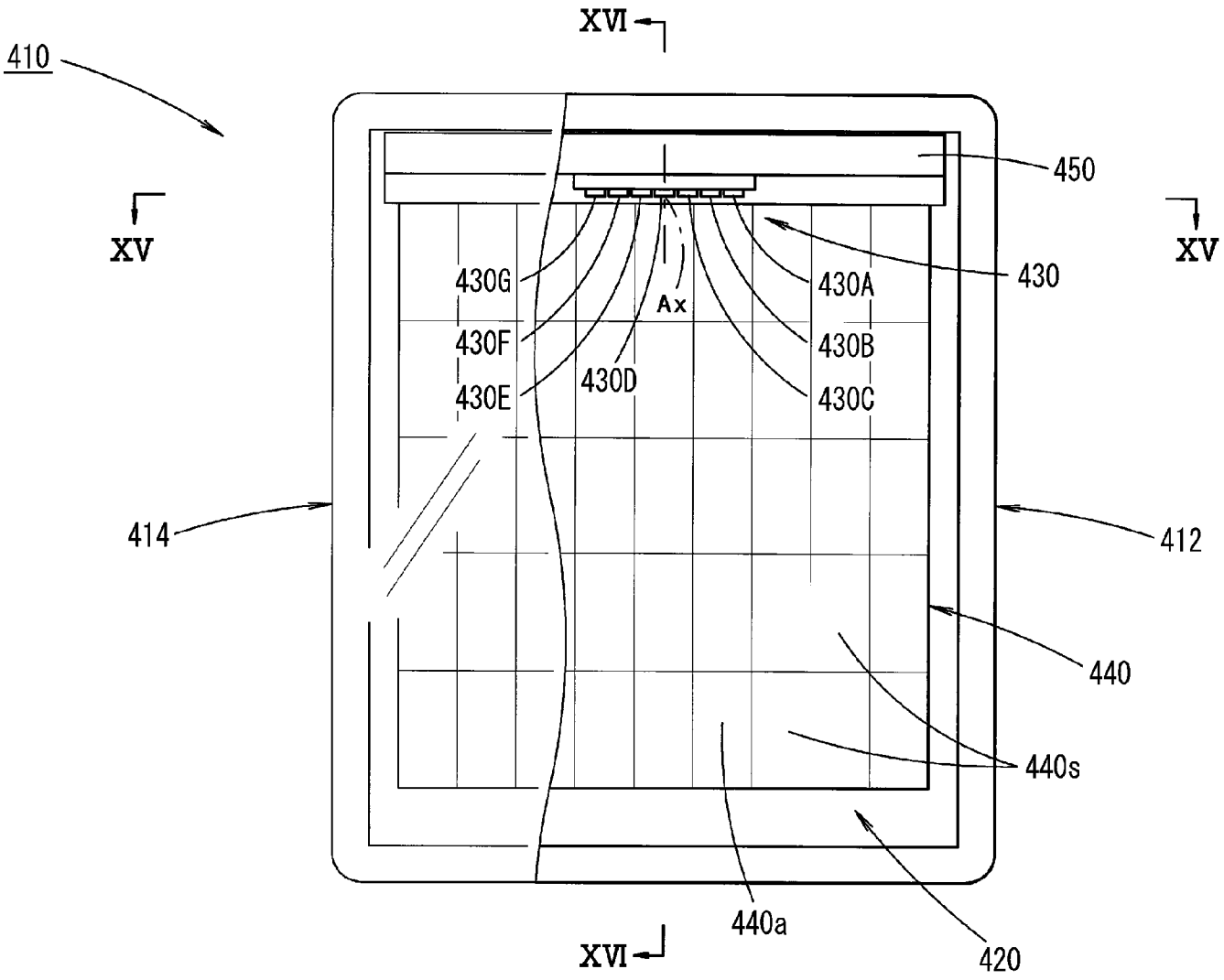
FIG. 14 is a front view depicting a vehicle lamp in accordance with a second illustrative embodiment.
Figure 15:
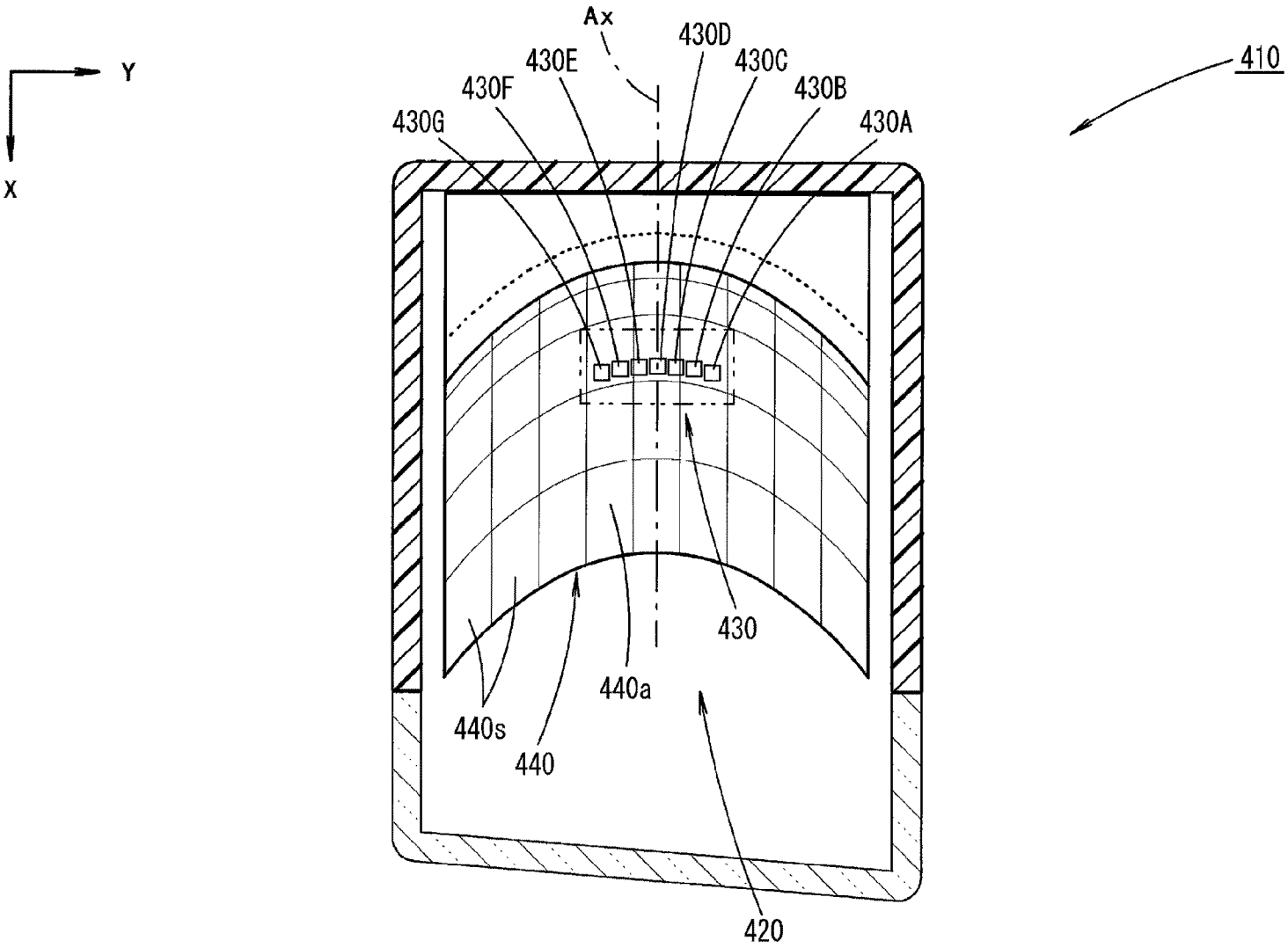
FIG. 15 is a sectional view taken along a line XV-XV of FIG. 14, as seen from an arrow direction.
Figure 16:
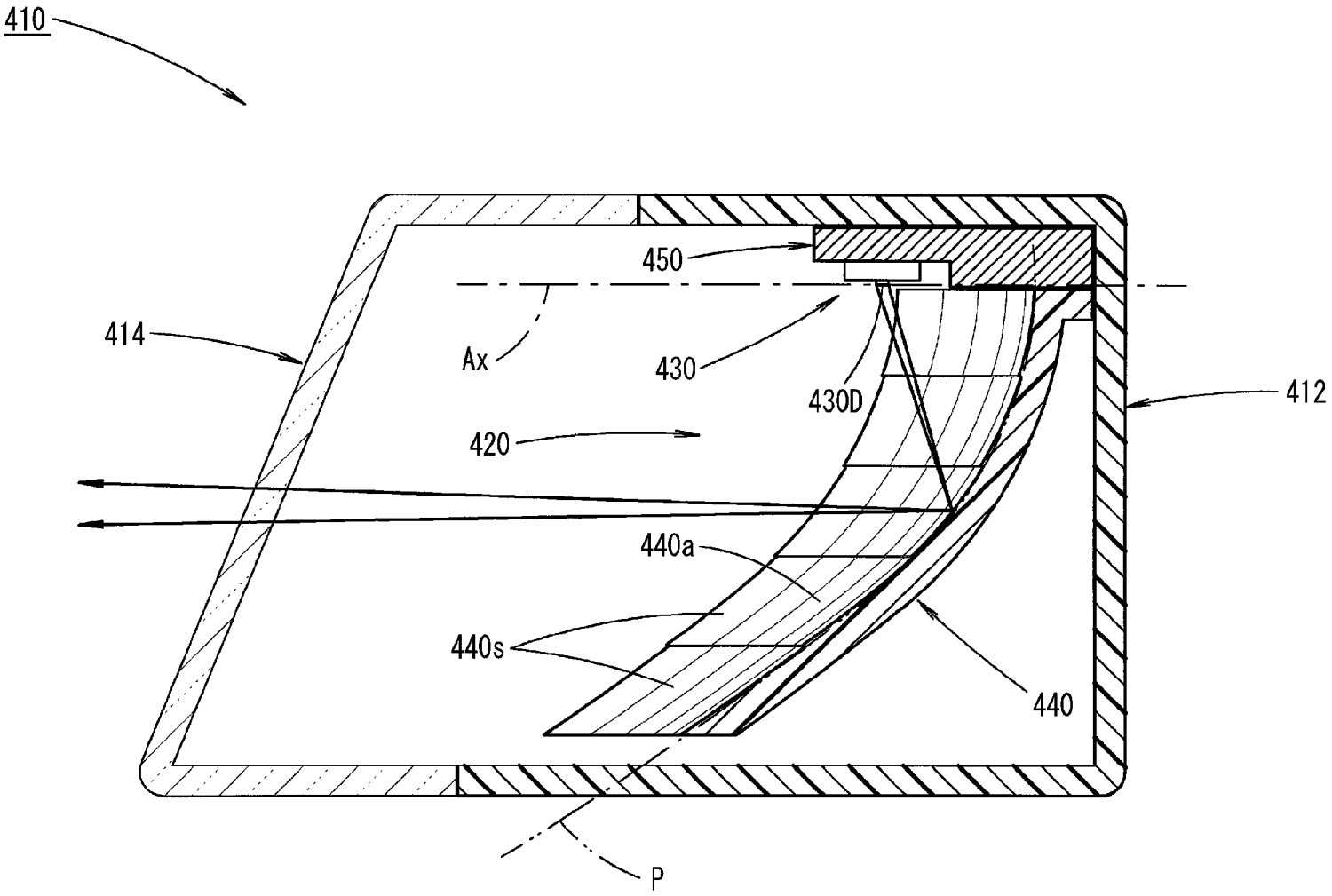
FIG. 16 is a sectional view taken along a line XVI-XVI of FIG. 14, as seen from an arrow direction.

FIG. 14 is a front view depicting a vehicle lamp 410 in accordance with a second illustrative embodiment. FIG. 15 is a sectional view taken along a line XV-XV of FIG. 14, as seen from an arrow direction. FIG. 16 is a sectional view taken along a line XVI-XVI of FIG. 14, as seen from an arrow direction.

The vehicle lamp 410 is a head lamp that is to be arranged at a right front end portion of a vehicle, and is configured to form an additive light distribution pattern (which will be described later) that is to be additionally formed on a light distribution pattern for low beam.

The vehicle lamp 410 has a configuration where a lamp unit 420 is incorporated in a lamp chamber formed by a lamp body 412 and a translucent cover 414 mounted to a front end opening of the lamp body.

The lamp unit 420 is configured as a reflector unit including a light source unit 430 and a reflector 440, and is supported to a support member 450.

The light source unit 430 includes seven light-emitting elements 430A, 430B, 430C, 430D, 430E, 430F, 430G. The seven light-emitting elements 430A to 430G are connected to a lighting control circuit (not shown) and are configured to be individually turned on and off.

Each of the light-emitting elements 430A to 430G is a white light-emitting diode of the same specification having a rectangular (for example, a square shape of 1 mm square) light-emitting surface, and is arranged with a light-emitting surface thereof facing downward. The light-emitting elements 430A to 430G are arranged so that both right and left end edges of each light-emitting surface thereof extends in the front and back direction of the vehicle.

The reflector 440 has a parabolic reflective surface 440*a* arranged below the light source unit 430.

Specifically, the reflective surface 440*a* has a plurality of reflection elements 440As formed by using, as a reference surface, a rotational paraboloid P (refer to FIG. 16) of which a central axis is an optical axis Ax extending in the front and back direction of the vehicle, and is configured to reflect forward emission light from the light-emitting elements 430A to 430G A surface shape of each reflection element 440As is set so that the reflective surface 440Aa slightly diffuses rightward and leftward the emission light from the light-emitting elements 430A to 430G.

The reflective surface 440*a* has a substantially rectangular outer shape, as seen from the front of the lamp, and an upper end edge thereof is positioned at substantially the same height as the optical axes Ax.

Figure 17:
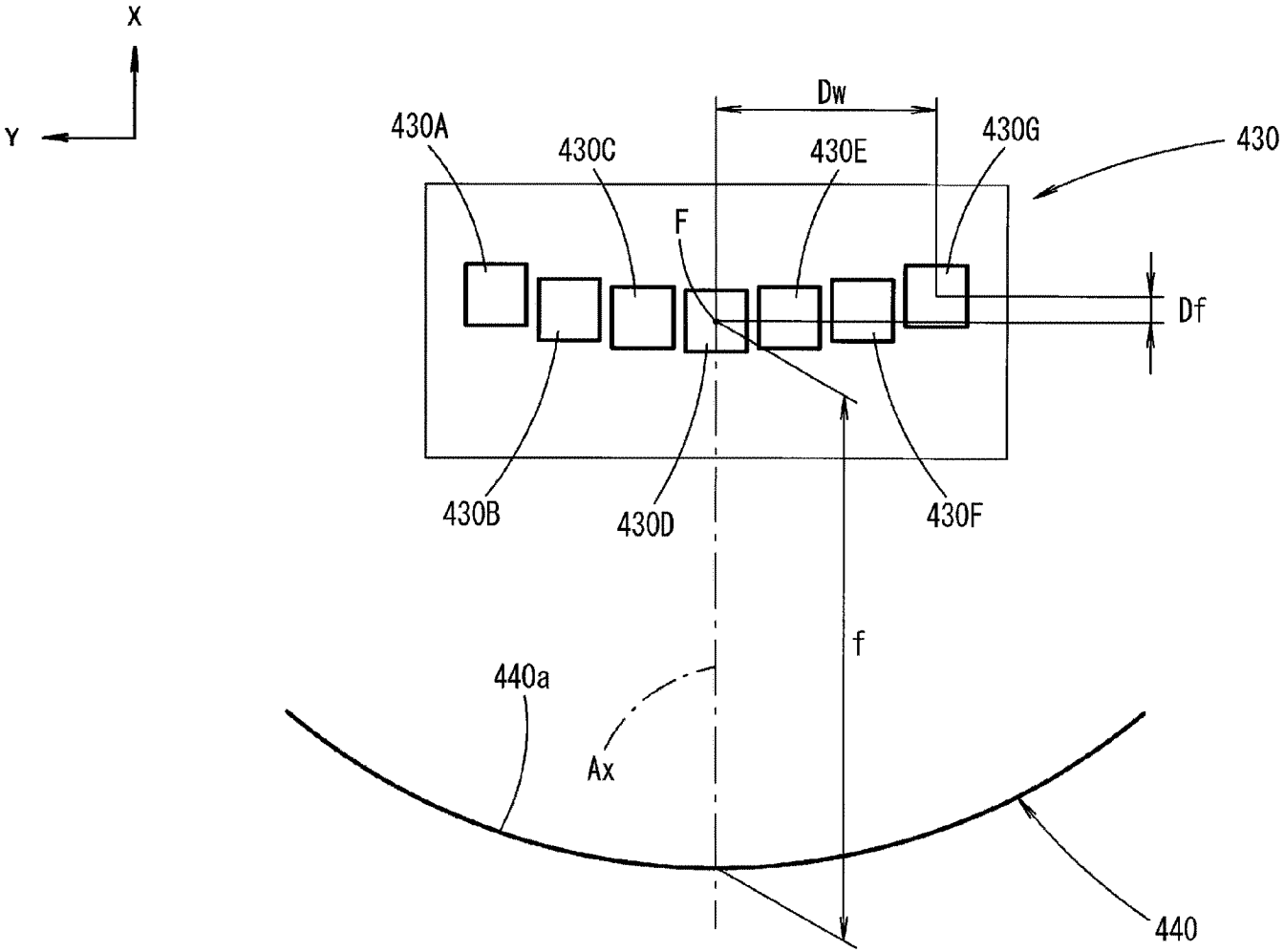
FIG. 17 is a plan view depicting a part of the vehicle lamp in accordance with the second illustrative embodiment at a state where

FIG. 17 is a plan view depicting a part of the vehicle lamp 410 at a state where FIG. 15 is rotated by 180°.

The seven light-emitting elements 430A to 430G configuring the light source unit 430 are equidistantly spaced in the vehicle width direction and are arranged to be bilaterally symmetric with respect to the optical axis Ax. The central light-emitting element 430D is arranged so that a light-emitting center thereof is positioned at a focus F of the reflective surface 440*a* (correctly, a focus of the rotational paraboloid P). The remaining six light-emitting elements 430A to 430C, 430E to 430G are arranged at both right and left sides of the light-emitting element 430D.

The six light-emitting elements 430A to 430C, 430E to 430G are arranged three by three with slight intervals each other. The six light-emitting elements 430A to 430C, 430E to 430G are arranged so that a light-emitting element located at a more distant position from the light-emitting element 430D in the vehicle width direction is located at a position deviating more forward from the light-emitting element 430D. Also, the six light-emitting elements 430A to 430C, 430E to 430G are arranged so that a light-emitting element more distant from the light-emitting element 430D more deviates forward from a light-emitting element adjacent to the optical axis Ax.

Specifically, the light-emitting elements 430A, 430G most distant from the focus F are set so that a distance Dw in the vehicle width direction between the light-emitting center and the focus F has a value of one-fifth or greater (for example, a value of one-fourth to a half) with respect to a focal distance f of the reflective surface 440*a* (correctly, a focal distance of the rotational paraboloid P) and so that a distance Df in the front and back direction between the light-emitting center and the focus F has a value of one-tenth or greater (for example, one-eights to one-fourth) with respect to the distance Dw in the vehicle width direction.

FIG. 18A depicts an additive light distribution pattern P0, which is to be formed on a virtual vertical screen arranged at a position of 25 m ahead of the lamp by illumination light from the vehicle lamp 410.

The additive light distribution pattern P1 is formed as a laterally long light distribution pattern that expands rightward and leftward about a V-V line perpendicularly passing a vanishing point ahead of the lamp.

The additive light distribution pattern P0 is formed so that a lower end edge P0*a* thereof extends substantially in the horizontal direction slightly below an H-H line passing horizontally the vanishing point and an upper end edge P0*b* thereof expands upward toward both right and left sides slightly above the H-H line.

The lower end edge P0*a* of the additive light distribution pattern P0 is located on the order of 1° below the H-H line at a position of the V-V line, and slightly expands downward toward both right and left sides. The upper end edge P0*b* of the additive light distribution pattern P0 is located on the order of 4° above the H-H line at the position of the V-V line and largely expands upward toward both right and left sides.

The additive light distribution pattern P0 is formed as a light distribution pattern obtained by superimposing seven light distribution patterns PA, PB, PC, PD, PE, PF, PG formed by the emission light from the seven light-emitting elements 430A to 430CG.

The central light distribution pattern PD is formed to have a substantially rectangular shape slightly expanding in the right and left direction about the V-V line. Since the light-emitting center of the light-emitting element 430D for forming the light distribution pattern PD is located at the focus F, an outer peripheral edge of the light distribution pattern PD is formed as a clear light-dark boundary.

A pair of light distribution patterns PC, PE positioned at both sides of the light distribution pattern PD is all formed to partially overlap with the light distribution pattern PD. Since the respective light-emitting centers of the light-emitting elements 430C, 430E for forming the light distribution patterns PC, PE are not much distant from the focus F, each outer peripheral edge of the light distribution patterns PC, PE is formed as a relatively clear light-dark boundary, and widths in the upper and lower direction are slightly greater than a width in the upper and lower direction of the light distribution pattern PD.

Each lower end edge of the light distributions patterns PC, PE is positioned at substantially the same height as the lower end edge of the light distribution pattern PD. Each upper end edge of the light distribution patterns PC, PE is located at a position higher than an upper end edge of the light distribution pattern PD. The reason is that the light-emitting elements 430C, 430E are arranged at more forward positions than the light-emitting element 430D.

A pair of light distribution patterns PB, PF positioned at both sides of the pair of light distribution patterns PC, PE is formed to partially overlap with the light distribution patterns PC, PE, respectively. Since the light-emitting centers of the light-emitting elements 430B, 430F for forming the light distribution patterns PB, PF are somewhat distant from the focus F, each outer peripheral edge of the light distribution patterns PB, PF is formed as a slightly blurry light-dark boundary, and widths in the upper and lower direction are greater than the widths in the upper and lower direction of the light distribution patterns PC, PE.

Each lower end edge of the light distribution patterns PB, PF is positioned at substantially the same height as each lower end edge of the light distribution patterns PC, PE. Each upper end edge of the light distribution patterns PB, PF is located at a position higher than each upper end edge of the light distribution patterns PC, PE. The reason is that the light-emitting elements 430B, 430F are arranged at more forward positions than the light-emitting elements 430C, 430E.

A pair of light distribution patterns PA, PG located at both sides of the pair of light distribution patterns PB, PF is formed to partially overlap with the light distribution patterns PB, PF, respectively. Since the light-emitting centers of the light-emitting elements 430A, 430G for forming the light distribution patterns PA, PG are considerably distant from the focus F, each outer peripheral edge of the light distribution patterns PA, PG is formed as a blurry light-dark boundary, and widths in the upper and lower direction are greater than the widths in the upper and lower direction of the light distribution patterns PB, PF.

Each lower end edge of the light distribution patterns PA, PG is positioned at substantially the same height as each lower end edge of the light distribution patterns PB, PF. Each upper end edge of the light distribution patterns PA, PG is located at a position higher than each upper end edge of the light distribution patterns PB, PF. The reason is that the light-emitting elements 430A, 430G are arranged at more forward positions than the light-emitting elements 430B, 430F.

FIG. 18B depicts the additive light distribution pattern P0 with being superimposed on the light distribution pattern for low beam PL that is to be formed by illumination light from another vehicle lamp (not shown). Since the light distribution pattern for low beam PL is the same as FIG. 8, the overlapping descriptions thereof are omitted.

The additive light distribution pattern P0 is formed so that the lower end portion is superimposed on the cut-off lines CL1, CL2 and expands upward from the cut-off lines CL1, CL2.

The dashed-two dotted line in FIG. 18B indicates an additive light distribution pattern P0' that is to be formed by illumination light from a vehicle lamp of the related art (i.e., a vehicle lamp in which the seven light-emitting elements similar to the seven light-emitting elements 430A to 430G are arranged on the same line extending in the vehicle width direction).

The additive light distribution pattern P0' is formed as a laterally long light distribution pattern that expands rightward and leftward about the V-V line. A lower end edge P0*a*' expands upward and downward toward both right and left sides. The reason is that the seven light-emitting elements equivalent to the seven light-emitting elements 430A to 430G are arranged on the same line extending in the vehicle width direction.

Since both end portions in the right and left direction of the additive light distribution pattern P0' are convex in the upper and lower direction, the downward convex sagging portion illuminates a road surface ahead of a vehicle, the road surface gets light beyond necessity, so that the visibility may be instead lowered.

On the other hand, since the sagging portions are little formed at both end portions in the right and left direction of the additive light distribution pattern P0 in accordance with the second illustrative embodiment, it is possible to avoid the situation where the road surface ahead of the vehicle is excessively illuminated.

FIG. 19A depicts an additive light distribution pattern P1, which is to be formed when only the third light-emitting element 430C from left of the seven light-emitting elements 430A to 430G is turned off, with being superimposed on the light distribution pattern for low beam PL.

The additive light distribution pattern P1 lacks in the light distribution pattern PC that is positioned at the slight right side of the V-V line, as compared to the additive light distribution pattern P0. Thereby, a dark part is formed between a left end edge PBa of the light distribution pattern PB and a right end edge PDa of the light distribution pattern PD.

The right end edge PDa of the light distribution pattern PD is formed as a clear light-dark boundary extending in the substantially vertical direction, and the left end edge PBa of the light distribution pattern PB is also formed as a slightly blurry light-dark boundary extending in the substantially vertical direction.

Therefore, when there is an oncoming vehicle 2 on the forward traveling road, the additive light distribution pattern P1 is formed, so that it is possible to widely illuminate the forward traveling road without causing a glare to a driver of the oncoming vehicle 2.

FIG. 19B depicts an additive light distribution pattern P2, which is to be formed when only the central light-emitting element 430D of the seven light-emitting elements 430A to 430G is turned off, with being superimposed on the light distribution pattern for low beam PL.

The additive light distribution pattern P2 lacks in the light distribution pattern PD that is positioned near the V-V line, as compared to the additive light distribution pattern P0. Thereby, a dark part is formed between a left end edge PCa of the light distribution pattern PC and a right end edge PEa of the light distribution pattern PE.

Both the left end edge PCa of the light distribution pattern PC and the right end edge Pea of the light distribution pattern PE are formed as relatively clear light-dark boundaries extending in the substantially vertical direction.

Therefore, when there is a forward traveling vehicle 4 on the forward traveling road, the additive light distribution pattern P2 is formed, so that it is possible to widely illuminate the forward traveling road without causing the glare to a driver of the forward traveling vehicle 4.

In the meantime, when the positions or numbers of the light-emitting elements to be turned off of the seven light-emitting elements 430A to 430G are appropriately changed in correspondence to the position of the oncoming vehicle 2 or the forward traveling vehicle 4, it is possible to form an additive light distribution pattern having a dark part at a position different from the additive light distribution patterns P1, P2.

Subsequently, operational effects of the second illustrative embodiment are described.

The vehicle lamp 410 of the second illustrative embodiment is configured to reflect forward the light from the seven light-emitting elements 430A to 430G arranged in the vehicle width direction by the reflector 440. The reflector 440 has the parabolic reflective surface 440*a* arranged below the seven light-emitting elements 430A to 430G. The seven light-emitting elements 430A to 430G are arranged so that a light-emitting element more distant from the focus F of the reflective surface 440*a* in the vehicle width direction is positioned at a more forward side. By this configuration, it is possible to accomplish following operational effects.

Similarly to the vehicle lamp of the related art, the light emitted from the light-emitting element (for example, the light-emitting elements 430A, 430G) arranged at the more distant position from the focus F of the reflective surface 440*a* of the reflector 440 in the vehicle width direction is more diffused in the upper and lower direction by the reflector 440, as compared to the light emitted from the light-emitting element (for example, the light-emitting element 430D) arranged at the closer position to the focus F in the vehicle width direction.

However, the seven light-emitting elements 430A to 430G are arranged so that a light-emitting element more distant from the focus F of the reflective surface 440*a* in the vehicle width direction is positioned at a more forward side. Thereby, as compared to the configuration of the related art where all the light-emitting elements are arranged on the same line extending in the vehicle width direction, it is possible to reduce a degree of downward diffusion by the reflector 440.

Therefore, it is possible to make it possible for the sagging portions to be formed at both end portions in the right and left direction of the additive light distribution pattern P0, which is to be formed by the simultaneous lighting of the seven light-emitting elements 430A to 430G, so that it is possible to avoid the situation where the road surface ahead of the vehicle is excessively illuminated.

The light emitted from the light-emitting element (for example, the light-emitting elements 430A, 430G) arranged at the relatively distant position from the focus F in the vehicle width direction is more diffused upward by the reflector 440, as compared to the configuration of the related art where all the light-emitting elements are arranged on the same line extending in the vehicle width direction. However, since the reflected light is not illuminated to the road surface ahead of the vehicle, it is not necessary to consider the excessive illumination.

Therefore, when the vehicle lamp 410 configured to reflect forward the light, which is to be emitted from the seven light-emitting elements 430A to 430G arranged in the vehicle width direction, by the reflector is provided, it is possible to avoid the excessive illumination to the road surface ahead of the vehicle, so that it is possible to suppress the visibility of the road surface from being lowered.

In the vehicle lamp 410 of the second illustrative embodiment, the distance Dw in the vehicle width direction between each light-emitting center of the light-emitting elements 430A, 430G arranged at the most distant positions from the focus F in the vehicle width direction and the focus F is one-fifth or greater of the focal distance f of the reflective surface 440*a*. In this case, the above-described effects are more conspicuous.

When the distance Dw in the vehicle width direction is large, the additive light distribution pattern P0, which is to be formed by the simultaneous lighting of the seven light-emitting elements 430A to 430G, has large sagging portions at both end portions thereof in the right and left direction if the seven light-emitting elements 430A to 430G are arranged on the same line extending in in the vehicle width direction, like the configuration of the related art. However, the configuration of the second illustrative embodiment is adopted, so that it is possible to effectively suppress the large sagging portion from being formed.

In the vehicle lamp 410 of the second illustrative embodiment, the distance Df in the front and back direction of the vehicle between each of the light-emitting centers of the light-emitting elements 430A, 430G arranged at the most distant positions from the focus F in the vehicle width direction and the focus is one-tenth or greater of the distance Dw in the vehicle width direction between the focus F and each light-emitting center of the light-emitting elements 430A, 430G arranged at the most distant positions from the focus F in the vehicle width direction. According to this configuration, it is possible to more effectively suppress the large sagging portion from being formed at both end portions in the right and left direction of the additive light distribution pattern P0, which is to be formed by the simultaneous lighting of the seven light-emitting elements 430A to 430G.

In the vehicle lamp 410 of the second illustrative embodiment, at least one of the seven light-emitting elements 430A to 430G is configured to be selectively turned on and off. According to this configuration, it is possible to form a plurality of types of shapes of additive light distribution patterns (for example, the shapes of the additive light distribution patterns P1, P2), in addition to the additive light distribution pattern P0, which is to be formed by the simultaneous lighting of the seven light-emitting elements 430A to 430G In this case, when the light-emitting elements to be selectively turned on and off are appropriately combined, it is possible to widely illuminate the forward traveling road without causing the glare to the driver of the oncoming vehicle 2 or the forward traveling vehicle 4.

In the second illustrative embodiment, the light source unit 430 has the seven light-emitting elements 430A to 430G. However, the light source unit 430 may be configured to have six or less light-emitting elements or eight or more light-emitting elements.

In the second illustrative embodiment, the light-emitting elements 430C, 430E positioned at both sides of the central light-emitting element 430D of the seven light-emitting elements 430A to 430G configuring the light source unit 430 are positioned at the more forward sides than the light-emitting element 430D. Also, the light-emitting elements 430B, 430F positioned at both sides of the light-emitting elements 430C, 430E are positioned at the more forward sides than the light-emitting elements 430C, 430E. Also, the light-emitting elements 430A, 430G positioned at both sides of the light-emitting elements 430B, 430F are positioned at the more forward sides than the light-emitting elements 430B, 430F. However, some light-emitting elements (for example, the light-emitting elements 430C, 430D, 430E), which are adjacent to each other in the vehicle width direction, of the seven light-emitting elements 430A to 430G may be arranged on the same line extending in the vehicle width direction. Also with this configuration, it is possible to reduce the degree of downward diffusion at both right and left end portions of the light distribution pattern, as compared to the configuration of the related are where all the light-emitting elements are arranged on the same line extending in the vehicle width direction.

In the second illustrative embodiment, the seven light-emitting elements 430A to 430G are equidistantly spaced in the vehicle width direction and are aligned in the bilaterally symmetric manner with respect to the optical axis Ax. However, the seven light-emitting elements 430A to 430G are not required to be necessarily equidistantly spaced in the vehicle width direction and are not required to be necessarily aligned in the bilaterally symmetric manner with respect to the optical axis Ax.

In the second illustrative embodiment, the head lamp that is to be arranged at the right front end portion of the vehicle has been exemplified as the vehicle lamp 410. However, the vehicle lamp 410 may also be configured as a head lamp that is to be arranged at a left front end portion of the vehicle.

In the second illustrative embodiment, the additive light distribution patterns P0, P1, P2 and the like, which are to be added to the light distribution pattern for low beam PL, are formed by the illumination light from the vehicle lamp 410. However, a light distribution pattern that is not on the premise of addition to the light distribution pattern for low beam PL may also be formed.

Subsequently, a modified embodiment of the second illustrative embodiment is described.

Figure 20:
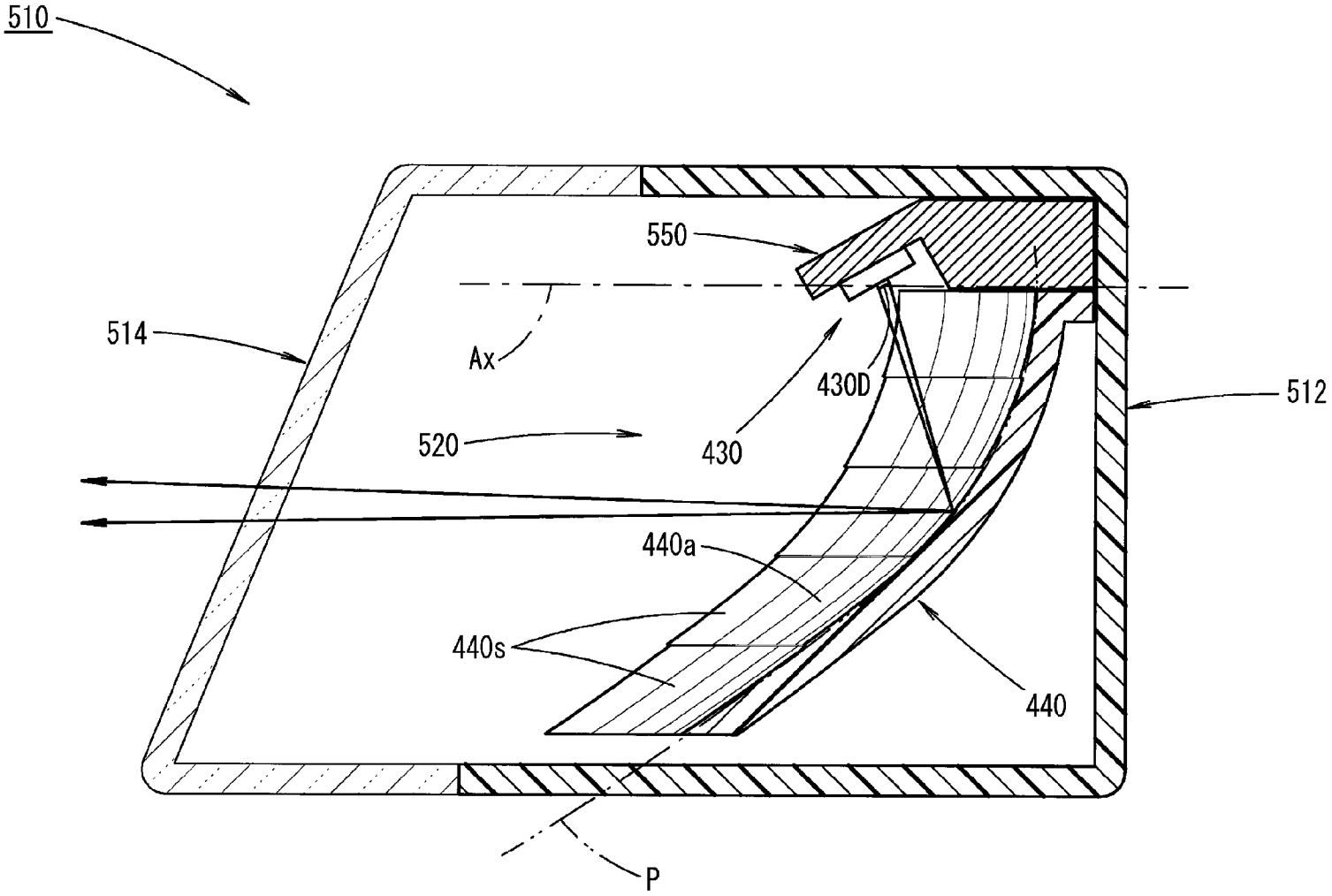
FIG. 20 is a view similar to FIG. 16, depicting a vehicle lamp in accordance with a modified embodiment of the second illustrative embodiment.

FIG. 20 is a view similar to FIG. 16, depicting a vehicle lamp 510 in accordance with the modified embodiment of the second illustrative embodiment.

As shown in FIG. 20, although the basic configuration of the vehicle lamp 510 is similar to the vehicle lamp 410 of the first illustrative embodiment, a direction of the light source unit 430 of a lamp unit 520 is different from the second illustrative embodiment.

That is, in this modified embodiment, the light-emitting element 430D and the like configuring the light source unit 430 of the lamp unit 520 are arranged with the light-emitting surfaces thereof facing obliquely downward toward the rear. Accompanied by this, shapes of a support member 550, a lamp body 512 and a translucent cover 514 are different from the second illustrative embodiment.

By adopting the configuration of the modified embodiment, it is possible to enable the more emission light from the light-emitting element 30A4 and the like to reach the reflective surface 440A of the reflector 440, so that it is possible to improve the illumination efficiency.

Subsequently, a third illustrative embodiment of the present invention is described.

Figure 21:
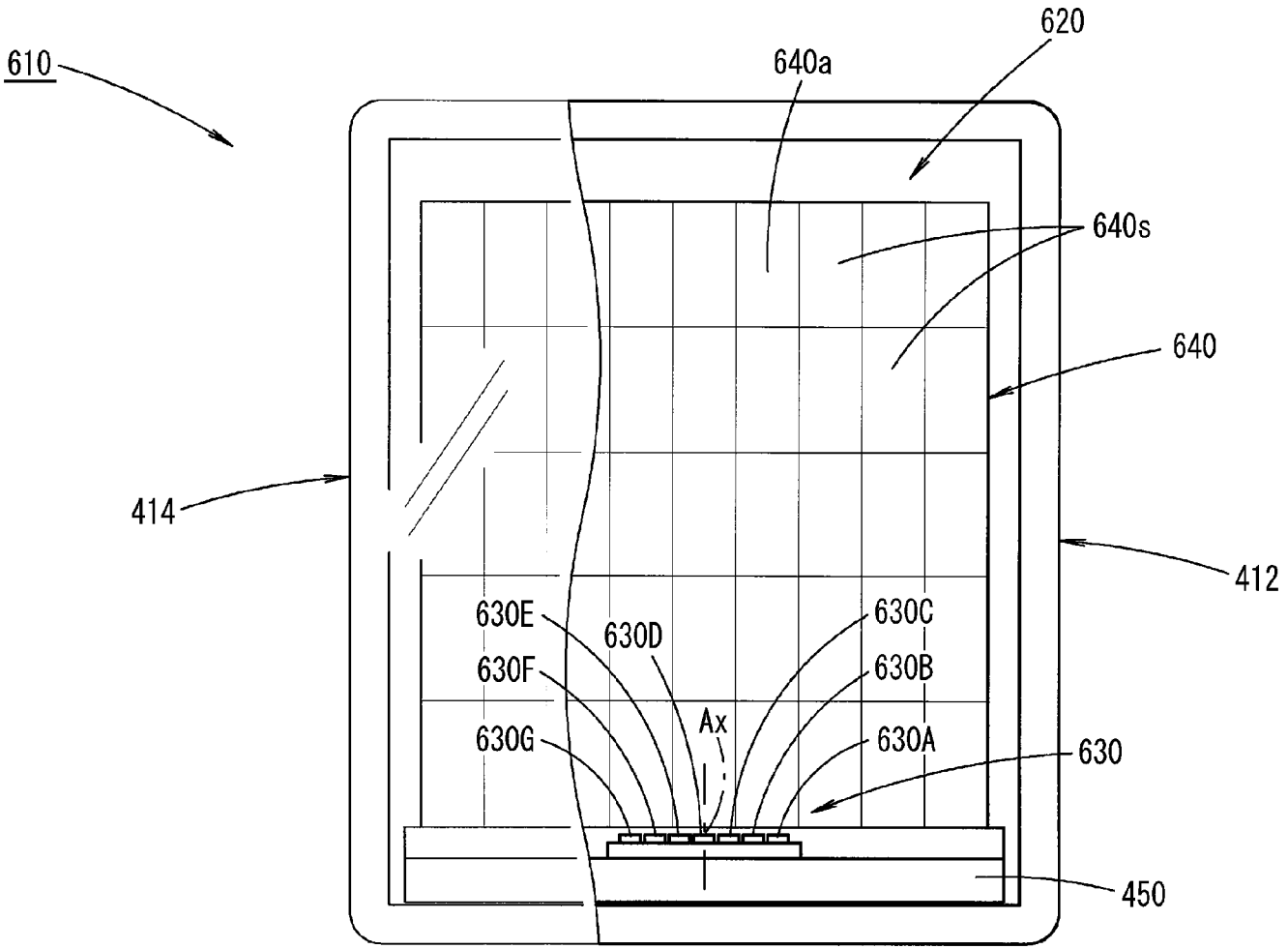
FIG. 21 is a view similar to FIG. 14, depicting a vehicle lamp in accordance with a third illustrative embodiment.
Figure 22:
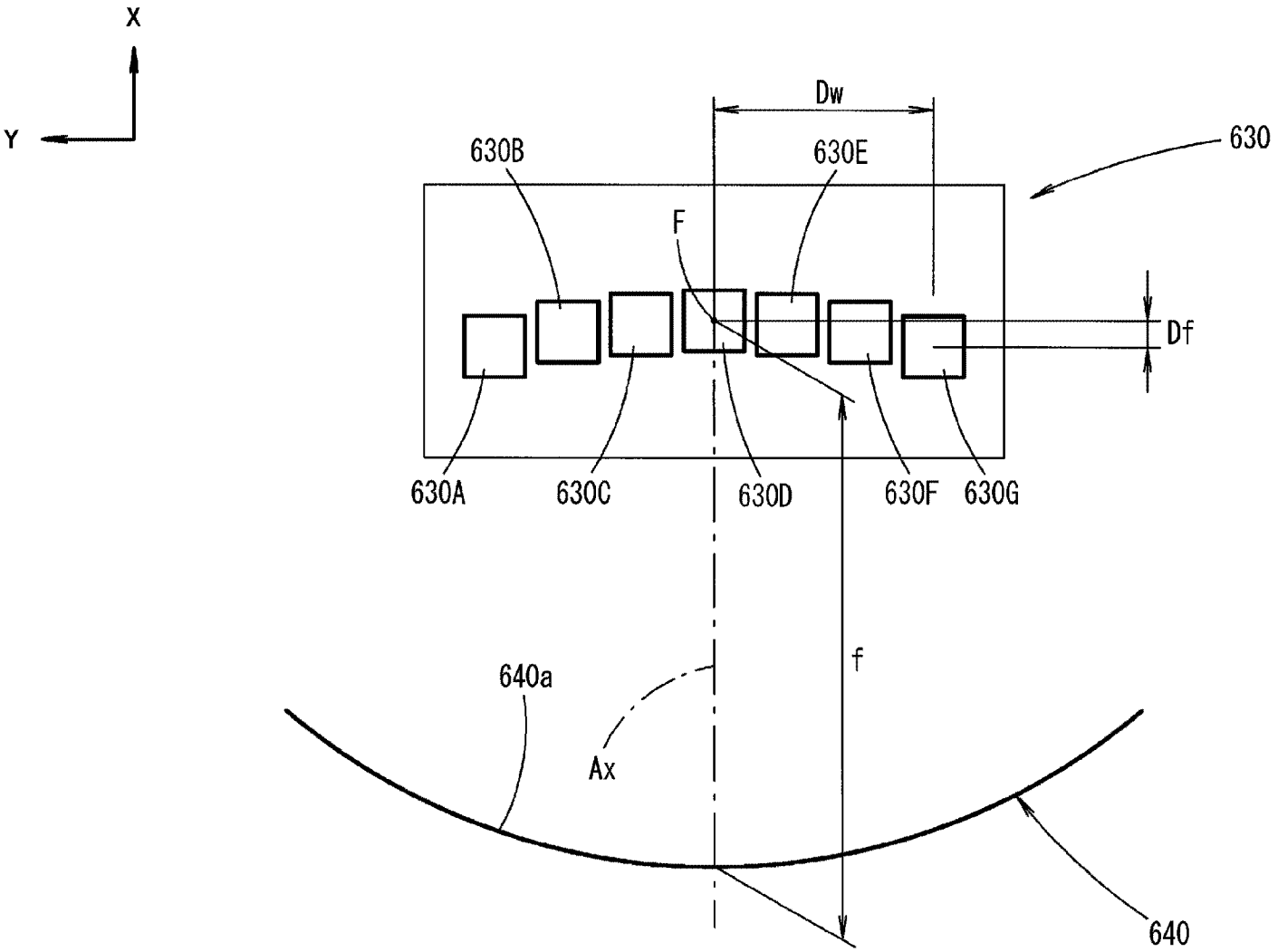
FIG. 22 is a view similar to FIG. 17, depicting a main part of the vehicle lamp in accordance with the third illustrative embodiment.

FIG. 21 is a view similar to FIG. 14, depicting a vehicle lamp 610 in accordance with the third illustrative embodiment. FIG. 22 is a view similar to FIG. 17, depicting a part of the vehicle lamp 610.

Although the basic configuration of the vehicle lamp 610 is similar to the vehicle lamp 410 of the second illustrative embodiment, a configuration of a lamp unit 620 is different from the second illustrative embodiment.

Although the lamp unit 620 of the third illustrative embodiment is configured as a reflector unit including a light source unit 630 and a reflector 640, the arrangement of the reflector 640 and the configuration of the light source unit 630 are different from the second illustrative embodiment.

The reflector 640 of the third illustrative embodiment has a configuration similar to the reflector 440 of the second illustrative embodiment. However, the reflector 440 of the second illustrative embodiment is inverted upside down. That is, the reflector 640 has a parabolic reflective surface 640*a* arranged above the light source unit 630. The reflective surface 640*a* has a plurality of reflection elements 640*s*.

The light source unit 630 of the third illustrative embodiment includes seven light-emitting elements 630A, 630B, 630C, 630D, 630E, 630F, 630G configured to be individually turned on and off, like the light source unit 430 of the second illustrative embodiment. The seven light-emitting elements 630A to 630G are arranged with light-emitting surfaces thereof facing upward. The seven light-emitting elements 630A to 630G are arranged so that a light-emitting element more distant from a focus F of the reflective surface 640*a* in the vehicle width direction is arranged at a position more deviating backward. That is, the seven light-emitting elements 630A to 630G are arranged at positions obtained by inverting the seven light-emitting elements 430A to 430G of the second illustrative embodiment in the front and back direction with respect to a line passing the focus F and extending in the vehicle width direction.

Figure 18:
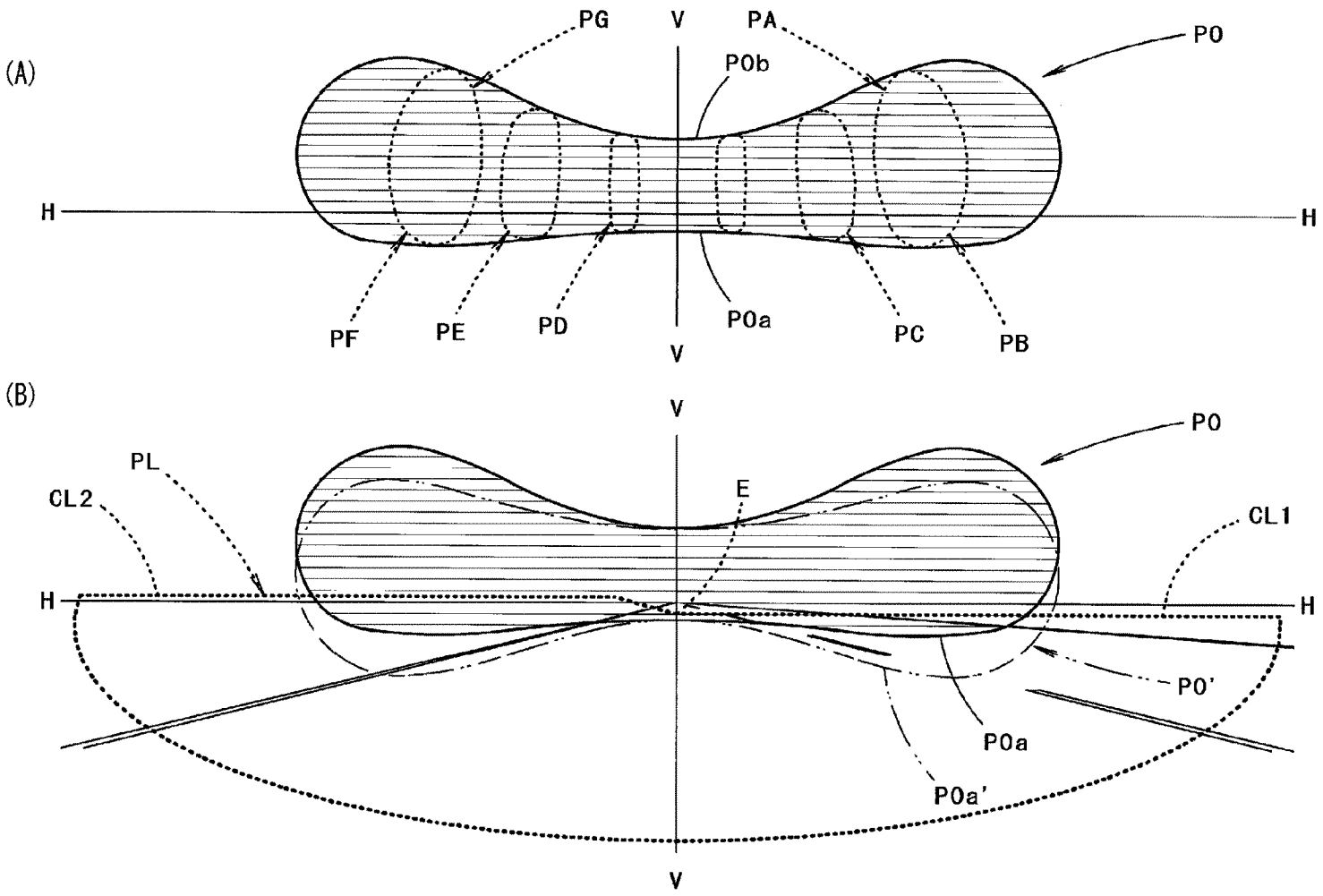
FIG. 18A depicts an additive light distribution pattern, which is to be formed on a virtual vertical screen arranged at a position of 25 m ahead of the lamp by illumination light from the vehicle lamp in accordance with the second illustrative embodiment.
FIG. 18B depicts the additive light distribution pattern with being superimposed on the light distribution pattern for low beam.
Figure 19:
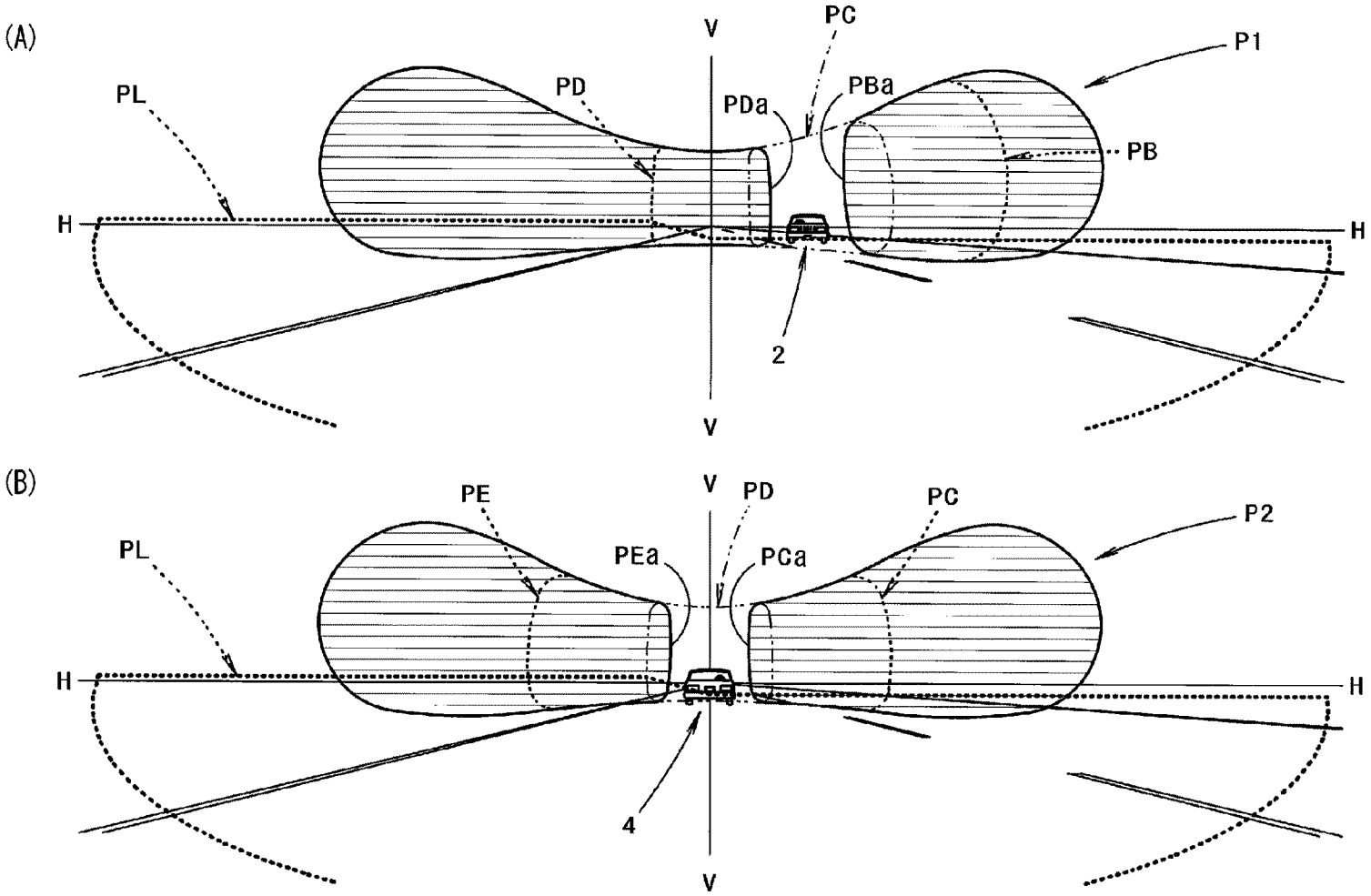

Thereby, also in the third illustrative embodiment, it is possible to form the additive light distribution patterns similar to the additive light distribution patterns P0, P1, P2 shown in FIGS. 18 and 19 by the illumination light from the vehicle lamp 610.

Therefore, also with the configuration of the third illustrative embodiment, it is possible to accomplish the operational effects similar to the second illustrative embodiment.

In the meantime, the numerical values described as the specification in the illustrative embodiments and the modified embodiments thereof are just exemplary, and can be appropriately set to different values.

The illustrative embodiments have been simply exemplified so as to easily understand the present invention. The configurations of the illustrative embodiments can be appropriately changed and improved without departing from the gist of the present invention. Also, it is obvious that the equivalents are also included within the technical scope of the present invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A vehicle lamp comprising:

a first lamp unit having a first light-emitting element group comprising at least first and second light-emitting elements arranged in a vehicle width direction;

a second lamp unit having a second light-emitting element group comprising at least third and fourth light-emitting elements arranged in the vehicle width direction;

a first-type wiring channel configured to turn on the first light-emitting element without turning on the second light-emitting element by supply of power and to form a first-type light distribution pattern, and a second-type wiring channel connecting the second light-emitting element in series with the third light-emitting element, to turn on the second and third light-emitting elements without turning on the first light-emitting element by supply of power and to form a second-type light distribution pattern, wherein a position of a light-dark boundary extending in an upper and lower direction in the first-type light distribution pattern is different from a position of a light-dark boundary extending in the upper and lower direction in the second-type light distribution pattern.

2. The vehicle lamp according to claim 1, wherein a shape of the first-type light distribution pattern is different from a shape of the second-type light distribution pattern.

3. The vehicle lamp according to claim 1, wherein brightness of the first-type light distribution pattern is different from brightness of the second-type light distribution pattern.

4. The vehicle lamp according to claim 1, wherein a distance in the vehicle width direction between an optical axis of the first lamp unit and an arrangement center of the first light-emitting element group is different from a distance in the vehicle width direction between an optical axis of the second lamp unit and an arrangement center of the second light-emitting element group.

5. The vehicle lamp according to claim 1, wherein an arrangement interval of the first light-emitting element group is different from an arrangement interval of the second light-emitting element group.

6. The vehicle lamp according to claim 1, wherein a number of light emitting elements in the first light-emitting element group is different from that of the second light-emitting element group.

7. The vehicle lamp according to claim 1, further comprising:

a third lamp unit having a third light-emitting element group comprising at least fifth and sixth light-emitting elements arranged in the vehicle width direction, and a third-type wiring channel connecting the fourth light-emitting element in series with the fifth light-emitting element, to turn on the fourth and fifth light-emitting elements without turning on the first, second, third, and sixth light-emitting elements by supply of power to form a third-type light distribution pattern.

8. The vehicle lamp according to claim 7, wherein the third-type wiring channel further connects the fourth light-emitting in series with an additional light-emitting element of the first light-emitting element group to turn on the additional light-emitting element to contribute to forming the third-type light distribution pattern.

9. The vehicle lamp according to claim 7, further comprising:

a fourth-type wiring channel that turns on the sixth light-emitting element without turning on the first, second, third, fourth, fifth, and sixth light-emitting elements by supply of power to form a fourth-type light distribution pattern.

10. A vehicle lamp comprising:

a plurality of light-emitting elements arranged in a vehicle width direction, and a reflector having a parabolic reflective surface configured to reflect forward light emitted from the plurality of light-emitting elements, wherein the reflective surface is arranged above or below the plurality of light-emitting elements, wherein when the reflective surface is arranged below the plurality of light-emitting elements, the plurality of light-emitting elements is arranged so that a light-emitting element located at a more distant position from a focus of the reflective surface in the vehicle width direction is located at a more forward position, wherein when the reflective surface is arranged above the plurality of light-emitting elements, the plurality of light-emitting elements is arranged so that a light-emitting element located at a more distant position from the focus of the reflective surface in the vehicle width direction is located at a more backward position, and wherein a distance in the vehicle width direction between a light-emitting center of a light-emitting element, which is located at the most distant position from the focus in the vehicle width direction, of the plurality of light-emitting elements and the focus is one-fifth or longer of a focal distance of the reflective surface.

11. The vehicle lamp according to claim 10, wherein at least one of the plurality of light-emitting elements can be selectively turned on and off.

12. A vehicle lamp comprising:

a plurality of light-emitting elements arranged in a vehicle width direction, and a reflector having a parabolic reflective surface configured to reflect forward light emitted from the plurality of light-emitting elements, wherein the reflective surface is arranged above or below the plurality of light-emitting elements, wherein when the reflective surface is arranged below the plurality of light-emitting elements, the plurality of light-emitting elements is arranged so that a light-emitting element located at a more distant position from a focus of the reflective surface in the vehicle width direction is located at a more forward position, wherein when the reflective surface is arranged above the plurality of light-emitting elements, the plurality of light-emitting elements is arranged so that a light-emitting element located at a more distant position from the focus of the reflective surface in the vehicle width direction is located at a more backward position, and wherein a distance in a front and back direction of a vehicle between a light-emitting center of a light-emitting element, which is located at the most distant position from the focus in the vehicle width direction, of the plurality of light-emitting elements and the focus is one-tenth or longer of a distance in the vehicle width direction between the light-emitting center and the focus.

13. A vehicle lamp comprising:

a first lamp unit having a plurality of first light-emitting elements arranged in a vehicle width direction;

a second lamp unit having a plurality of second light-emitting elements arranged in the vehicle width direction;

a first-type wiring channel configured to turn on a part of the plurality of first light-emitting elements by supply of power and to form a first-type light distribution pattern, and a second-type wiring channel configured to connect a part of the plurality of first light-emitting elements in series with at least one of the plurality of second light-emitting elements, to turn on the light-emitting elements by supply of power and to form a second-type light distribution pattern, wherein a position of a light-dark boundary extending in an upper and lower direction in the first-type light distribution pattern is different from a position of a light-dark boundary extending in the upper and lower direction in the second-type light distribution pattern.

14. The vehicle lamp according to claim 13, wherein a shape of the first-type light distribution pattern is different from a shape of the second-type light distribution pattern.

15. The vehicle lamp according to claim 13, wherein brightness of the first-type light distribution pattern is different from brightness of the second-type light distribution pattern.

16. The vehicle lamp according to claim 13, wherein a distance in the vehicle width direction between an optical axis of the first lamp unit and an arrangement center of the plurality of first light-emitting elements is different from a distance in the vehicle width direction between an optical axis of the second lamp unit and an arrangement center of the plurality of second light-emitting elements.

17. The vehicle lamp according to claim 13, wherein an arrangement interval of the plurality of first light-emitting elements is different from an arrangement interval of the plurality of second light-emitting elements.

18. The vehicle lamp according to claim 13, wherein a number of the plurality of first light-emitting elements is different from a number of the plurality of second light-emitting elements.

* * * * *